US007216637B2

(12) United States Patent
Uchida et al.

(10) Patent No.: US 7,216,637 B2
(45) Date of Patent: May 15, 2007

(54) EVAPORATIVE FUEL HANDLING APPARATUS

(75) Inventors: Akikazu Uchida, Kariya (JP); Hiroshi Nakamura, Nishio (JP); Yasunori Kobayashi, Toyohashi (JP)

(73) Assignee: DENSO Corporation, Kariya (JP)

( * ) Notice: Subject to any disclaimer, the term of this patent is extended or adjusted under 35 U.S.C. 154(b) by 0 days.

(21) Appl. No.: 11/494,521

(22) Filed: Jul. 28, 2006

(65) Prior Publication Data

US 2007/0023015 A1 Feb. 1, 2007

(30) Foreign Application Priority Data

Jul. 29, 2005 (JP) ..... 2005-221086

(51) Int. Cl.
*F02M 33/02* (2006.01)

(52) U.S. Cl. ..... 123/520; 123/198 D; 73/118.1; 73/119 A

(58) Field of Classification Search ..... 123/520, 123/516, 518, 519, 198 D; 73/118.1, 119 A
See application file for complete search history.

(56) References Cited

U.S. PATENT DOCUMENTS 5,146,902 A * 9/1992 Cook et al. ..... 123/518
5,273,020 A * 12/1993 Hayami ..... 123/520
5,349,935 A * 9/1994 Mezger et al. ..... 123/520
5,881,700 A * 3/1999 Gras et al. ..... 123/520
5,890,474 A * 4/1999 Schnaibel et al. ..... 123/520
6,131,550 A * 10/2000 Fritz et al. ..... 123/520
6,247,458 B1 * 6/2001 Heinemann et al. ..... 123/520
6,250,288 B1 * 6/2001 Fritz ..... 123/520
6,321,728 B1 * 11/2001 Ohkuma ..... 123/520
6,695,895 B2 2/2004 Hyodo et al.
7,004,013 B2 2/2006 Kobayashi et al.
2003/0226549 A1 * 12/2003 Takagi et al. ..... 123/520
2005/0022588 A1 * 2/2005 Hayakawa et al. ..... 73/118.1
2006/0016253 A1 * 1/2006 Kobayashi et al. ..... 73/118.1
2006/0042605 A1 * 3/2006 Amano et al. ..... 123/520

* cited by examiner

*Primary Examiner*—Carl S. Miller
(74) *Attorney, Agent, or Firm*—Nixon & Vanderhye P.C.

(57) ABSTRACT

A fuel handling apparatus with a purge system, a first communication passage, and a second communication passage with a greater pressure loss than the first communication passage. A check device is coupled to the second communication passage for checking a leak of evaporative fuel from the purge system. A pump is included, and a selector device is included for switching fluid communication of the pump between one of the first communication passage and the second communication passage. A controller controls the selector device to allow fluid communication between the first communication passage and the pump and then controls the pump to produce the pressure difference for forcible purging. The controller further controls the selector device to allow fluid communication between the second communication passage and the pump, and then controls the pump to produce the pressure difference and controls the check device for leak checking.

14 Claims, 19 Drawing Sheets

EVAPORATIVE FUEL HANDLING APPARATUS

CROSS REFERENCE TO RELATED APPLICATION

The following is based on and claims priority to Japanese Patent Application No. 2005-221086, filed Jul. 29, 2005, which is herein incorporated by reference in its entirety.

FIELD

The present invention relates to fuel handling and, more particularly, relates to an evaporative fuel handling apparatus for handling evaporative fuel produced in a fuel tank.

BACKGROUND

It is known to provide an evaporative fuel handling apparatus having a purge system. The purge system purges evaporative fuel produced in a fuel tank into an air intake system of an engine. Technology has been proposed for performing forcible purge of evaporative fuel into an air intake system by producing a pressure difference with a pump between the inside and outside of the purge system (see, e.g., U.S. Pat. No. 6,695,895, JP-2002-332921A). Technology has also been proposed for checking for leaks in the purge system by producing a pressure difference with a pump between the inside and outside of the purge system (see, e.g., U.S. Pat. No. 7,004,013, JP-2004-28060A).

The size and weight of the evaporative fuel handling apparatus could be reduced if the same components operate for both forcibly purging and checking for leaks. For instance, the size and weight could be reduced by using a pump common to both purging and leak checking operations. However, the requirements for pump for performing forcible purge are substantially different than those of a pump for leak checking. As such, incorporation of a common pump can be difficult.

More specifically, the pump for performing forcible purge (i.e., the purge pump) provides a relatively large flow rate for purge and sets a produced pressure at a specified value lower than a threshold value at which resistance to pressure exists. Hence, as shown by the solid line of FIG. 7, a characteristic curve relating pressure (P) and flow rate (Q) for the purge pump has a relatively large slope. Like the purge pump, the pump for leak checking sets a produced pressure at a specified value lower than a threshold value at which resistance to pressure exists; however, the pump for leak checking increases the change in produced pressure with respect to a change in flow rate. Hence, as shown by the broken line of FIG. 7, the slope of the characteristic curve relating pressure (P) and flow rate (Q) is lower. Thus, for example, if a pump set for performing forcible purge is used for leak checking, the slope of the P-Q characteristic curve is likely to be too large. Hence, a change in pressure with respect to a change in flow rate becomes too small, which causes reduced accuracy when leak checking.

SUMMARY OF THE INVENTION

An evaporative fuel handling apparatus for a vehicle with an air intake system of an engine and a fuel tank is disclosed. The evaporative fuel handling apparatus includes a purge system for purging evaporative fuel from the fuel tank into the air intake system. A first communication passage is fluidly coupled with the purge system. A second communication passage is fluidly coupled with the purge system and has a greater loss of pressure of flowing fluid than the first communication passage. A check device is coupled to the second communication passage for checking a leak of evaporative fuel from the purge system. A pump is included for producing a pressure difference between the inside and the outside of the purge system. A selector device is included for switching fluid communication of the pump between one of the first communication passage and the second communication passage. A controller controls the selector device to allow fluid communication between the first communication passage and the pump and then controls the pump to produce the pressure difference to thereby perform forcible purge of evaporative fuel. The controller further controls the selector device to allow fluid communication between the second communication passage and the pump, and then controls the pump to produce the pressure difference and controls the check device to check for a leak of evaporative fuel.

DETAILED DESCRIPTION OF THE PREFERRED EMBODIMENTS

Hereinafter, a plurality of embodiments of the present invention will be described in reference to the drawings. The same reference numbers will be used to denote similar elements in the embodiments.

First Embodiment

Figure 1:
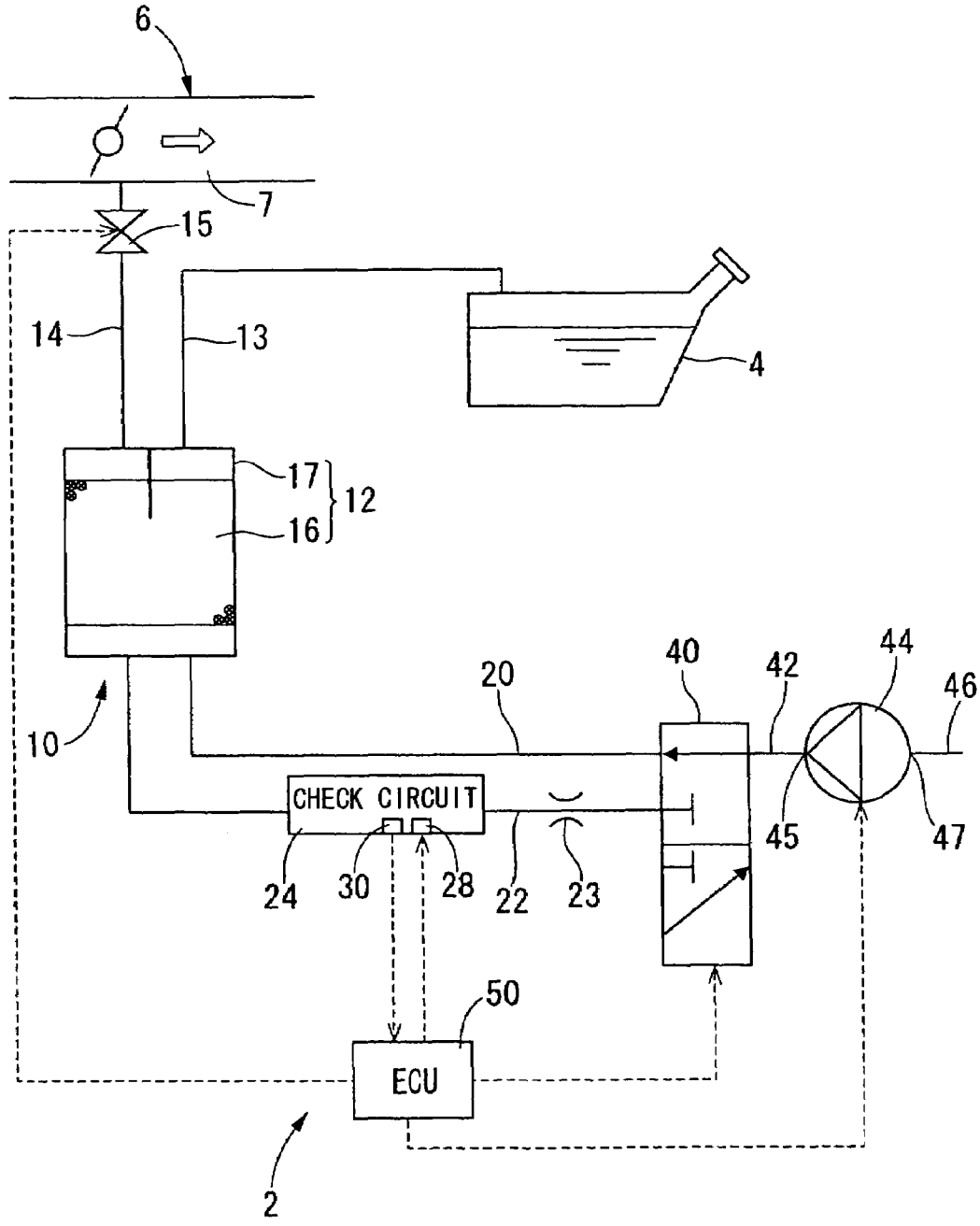
FIG. 1 is a block diagram showing an evaporative fuel handling apparatus according to a first embodiment.

FIG. 1 shows an evaporative fuel handling apparatus 2 according to a first embodiment of the present invention. The evaporative fuel handling apparatus 2 is mounted in a vehicle and handles evaporative fuel produced in a fuel tank 4 and purges the evaporative fuel into an intake passage 7 of an air intake system of an internal combustion engine 6. The evaporative fuel handling apparatus 2 includes a purge system 10, a first communication passage 20, a second communication passage 22, a selector valve 40, a pump passage 42, a pump 44, an open passage 46, and an electronic control unit 50 (hereinafter referred to as an "ECU").

The purge system 10 includes a fuel tank 4, a canister 12, an introduction passage 13, a purge passage 14, and a purge control valve 15.

The canister 12 includes a case 17 and adsorbent 16 within the case 17. The adsorbent 16 can be of any suitable type such as activated charcoal. The canister 12 is fluidly coupled to the fuel tank 4 through the introduction passage 13. Hence, evaporative fuel produced in the fuel tank 4 can flow through the introduction passage 13 into the canister 12 and be adsorbed by the adsorbent 16 in the canister 12 (i.e., the evaporative fuel is desorbed).

The canister 12 is fluidly coupled with the purge passage 14 such that the canister 12 is fluidly coupled to intake passage 7. In the embodiment shown, the purge control valve 15 is included in the purge passage 14 such that fluid flowing away from the canister 12 flows through the purge control valve 15. In one embodiment, the purge control valve 15 is an electromagnetically driven two-way valve. The purge control valve 15 is opened and closed to control the opening and closing of the purge passage 14. Hence, in a state where the purge passage 14 is opened, evaporative fuel desorbed from the adsorbent 16 in the canister 12 can be purged into the intake passage 7. More specifically, evaporative fuel purged into the intake passage 7 and fuel injected from a fuel injection valve (not shown) of the internal combustion engine 6 are combusted together in the internal combustion engine 6.

The first and second communication passages 20, 22 are also fluidly coupled to the canister 12. The canister 12 is provided between the first and second communication passages 20, 22 and the passages 13, 14. In the embodiment shown, the first communication passage 20 is directly fluidly coupled to the canister 12. Hence, this can shorten the first communication passage 20 and coincidentally reduce the size of the apparatus 2.

A restrictor 23 for restricting an axial cross sectional area of the fluid flow passage is fluidly coupled to the second communication passage 22. In other words, the axial cross sectional area of the restrictor 23 is less than the axial cross sectional area of the second communication passage 22. Due to the restrictor 23, pressure loss in the second communication passage 22 is larger than pressure loss in the first communication passage 20.

Figure 2:
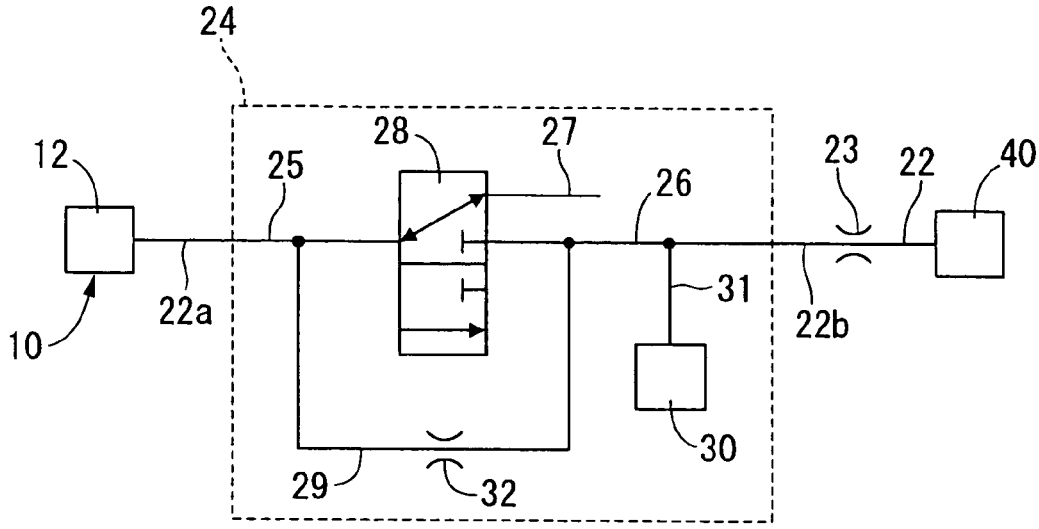
FIG. 2 is a block diagram of a check circuit of the embodiment of FIG. 1.

A check circuit 24 is provided in the second communication passage 22 between the restrictor 23 and the canister 12. As shown in FIG. 2, the check circuit 24 includes a first check passage 25, a second check passage 26, an atmosphere passage 27, a communication control valve 28, a restriction passage 29, a pressure sensor 30, a pressure introduction passage 31, and the like. The first check passage 25 is fluidly coupled to a portion 22*a* of the second communication passage 22 that is directly coupled to the canister 12. The second check passage 26 is fluidly coupled with a portion 22*b* of the second communication passage 22 that is directly coupled to restrictor 23. The atmosphere passage 27 is open to the atmosphere at a terminal end. In one embodiment, the communication control valve 28 is made of an electromagnetically driven three-way valve connected to the passages 25, 26, 27. The communication control valve 28 and switches to allow fluid communication (i.e., fluid flow) between the first check passage 25 and either the second check passage 26 or the atmosphere passage 27. The restriction passage 29 bypasses the communication control valve 28 and fluidly couples the first check passage 25 and the second check passage 26. A check restrictor 32 is included in the restriction passage 29 and restricts the axial cross sectional area of the restriction passage 29. Here, the axial cross sectional area at the check restrictor 32 is smaller than the axial cross sectional area at the restrictor 23. The pressure sensor 30 is fluidly coupled with the second check passage 26 through the pressure introduction passage 31 and detects pressure in the second check passage 26 supplied through the pressure introduction passage 31.

Referring back to FIG. 1, the selector valve 40 is fluidly coupled to the passages 20, 22, and 42. The selector valve 40 switches to allow fluid communication (i.e., fluid flow) between the pump passage 42 and either the communication passage 20 or the second communication passage 22. In one embodiment, the selector valve 40 is an electromagnetically driven three-way valve.

In one embodiment, the pump 44 is an electrically operated pump capable of changing the direction of discharge of fluid. The pump 44 has a first port 45 fluidly coupled to the pump passage 42 and a second port 47 fluidly coupled to the open passage 46. Here, the open passage 46 is open to the atmosphere at one end. Hence, when the first port 45 becomes a discharge side and the second port 47 becomes a suction side, one of the passages 20, 22 is pressurized depending on the configuration of the selector valve 40. In contrast, when the first port 45 becomes a suction side and the second port 47 becomes a discharge side, one of the passages 20, 22 is depressurized depending on the configuration of the selector valve 40.

In one embodiment, the ECU 50 includes a microcomputer having a CPU and a memory. The ECU 50 is electrically connected to the valves 15, 28, 40, the pressure sensor 30, and the pump 44 for controlling the operation of the same. In one embodiment, the ECU 50 also controls the internal combustion engine 6.

Figure 3:
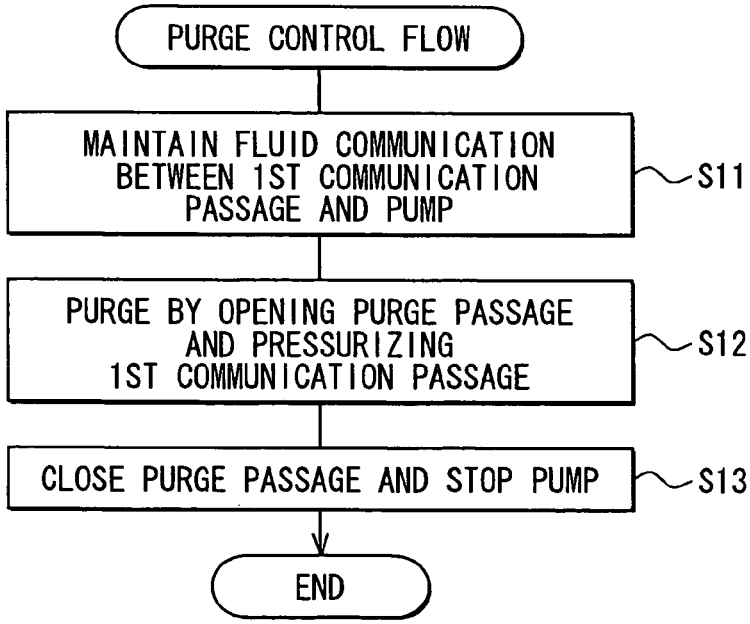
FIG. 3 is a flow chart showing the operation of the evaporative fuel handling apparatus of FIG. 1.

Next, the purge control flow of the evaporative fuel handling apparatus 2 will be described on the basis of the flow chart of FIG. 3.

The purge control flow starts when a purge start condition is established after the internal combustion engine 6 is started. In one embodiment, the purge start condition is established when a predetermined condition of the vehicle exists (e.g., the temperature of cooling water of the internal combustion engine 6, the RPM of the internal combustion engine 6, and/or the temperature of hydraulic oil is/are within predetermined ranges). Moreover, when the purge control flow starts, the selector valve 40 is configured to allow fluid communication (i.e., fluid flow) between the first communication passage 20 and the pump 44, the pump 44 is stopped, and purge control valve 15 closes the purge passage 14.

In step S11 of the purge control flow, the ECU 50 controls the selector valve 40 to maintain fluid communication between the first communication passage 20 and the pump 44 as shown in FIG. 1. Here, this state is maintained at least until the purge control flow is finished. Next, in step S12, the ECU 50 controls the purge control valve 15 to open the purge passage 14 and controls the pump 44 to pressurize the first communication passage 20. This action of pressurizing extends to the canister 12 and the purge passage 14, such that evaporative fuel is desorbed from the adsorbent 16 in the canister 12 and is forcibly purged into the intake passage 7. Hence, the amount of purged fuel can be adjusted by controlling of flow rate of the pump 44.

Then, a purge stop condition is established during the forcible purge. In one embodiment, the purge stop condition is established when a predetermined condition of the vehicle exists (e.g., the RPM of the internal combustion engine 6 and/or the accelerator position of the vehicle is/are within predetermined ranges different from those of the above-mentioned purge start conditions). Once the purge stop condition is established, the method of operation moves to step S13 in which the ECU 50 controls the purge control valve 15 to close the purge passage 14 and stops the pump 44. As such, the forcible purge is stopped and the purge control flow is completed.

Figure 4:
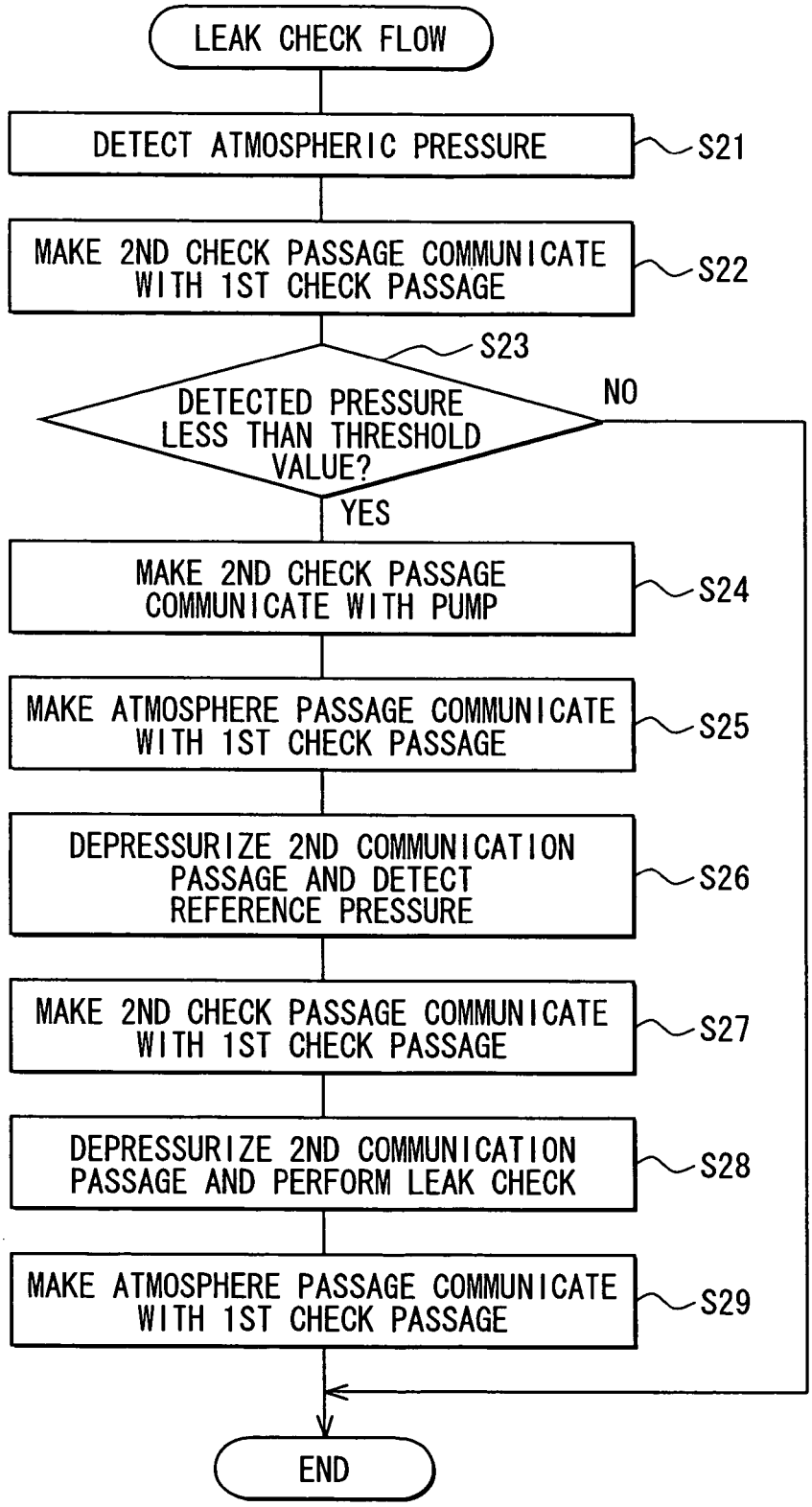
FIG. 4 is a flow chart showing the operation of the evaporative fuel handling apparatus of FIG. 1.

Next, the leak check flow of the evaporative fuel handling apparatus 2 will be described on the basis of a flow chart in FIG. 4.

The leak check flow is started after the internal combustion engine 6 is stopped. When the leak check flow is started, the first communication passage 20 is made to communicate with the pump 44 by the selector valve 40, the atmosphere passage 27 is made to communicate with the first check passage 25 by the communication control valve 28, the purge passage 14 is brought into a closed state by the purge control valve 15, and the pump 44 is stopped.

In step S21 of the leak check flow, the ECU 50 controls the pressure sensor 30 to detect the pressure of the second check passage 26. The second check passage 26 is in communication with the atmosphere passage 27 through the restriction passage 29. Therefore, the pressure detected at this time is substantially equal to the atmospheric pressure of the atmosphere passage 27.

Figure 6:
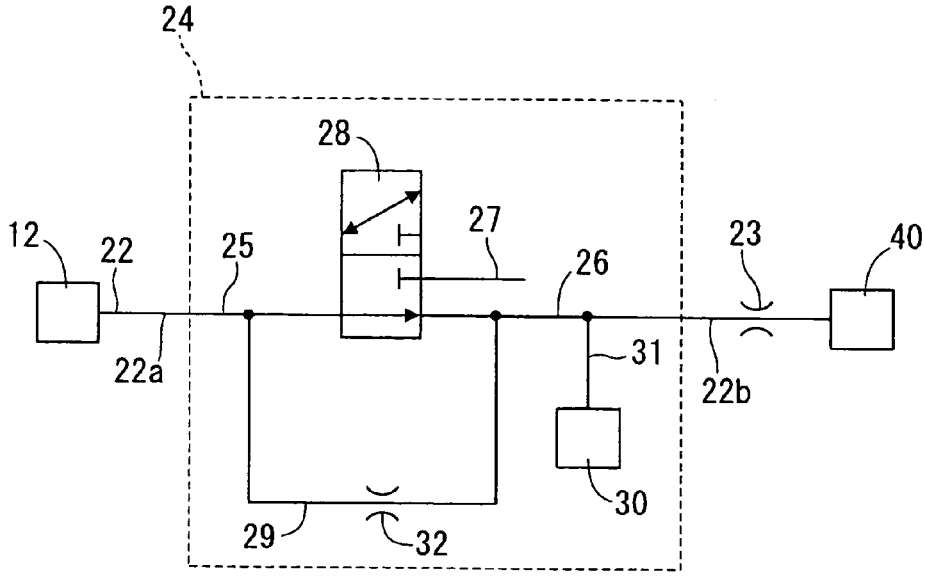
FIG. 6 is a block diagram showing the operation of the check circuit of FIG. 1.

When the atmospheric pressure is detected, in step S22, the ECU 50 controls the communication control valve 28 to make the second check passage 26 communicate with the first check passage 25 as shown in FIG. 6. Then, in step S23, the ECU 50 controls the pressure sensor 30 to again detect the pressure in the second check passage 26. The second check passage 26 is fluidly coupled to the fuel tank 4 through the first check passage 25, and as such, the pressure detected is more than the atmospheric pressure if evaporative fuel is present in the fuel tank 4. Hence, in step S23, the ECU 50 determines whether evaporative fuel is present in the fuel tank 4 on the basis of the detected pressure. If the detected pressure is higher than a threshold value, the ECU 50 determines that the production of evaporative fuel is excessive and finishes the leak check flow. In contrast, when the detected pressure is lower than the threshold valve, the ECU 50 determines that the production of evaporative fuel is stable and advances the leak check flow to step S24.

Figure 5:
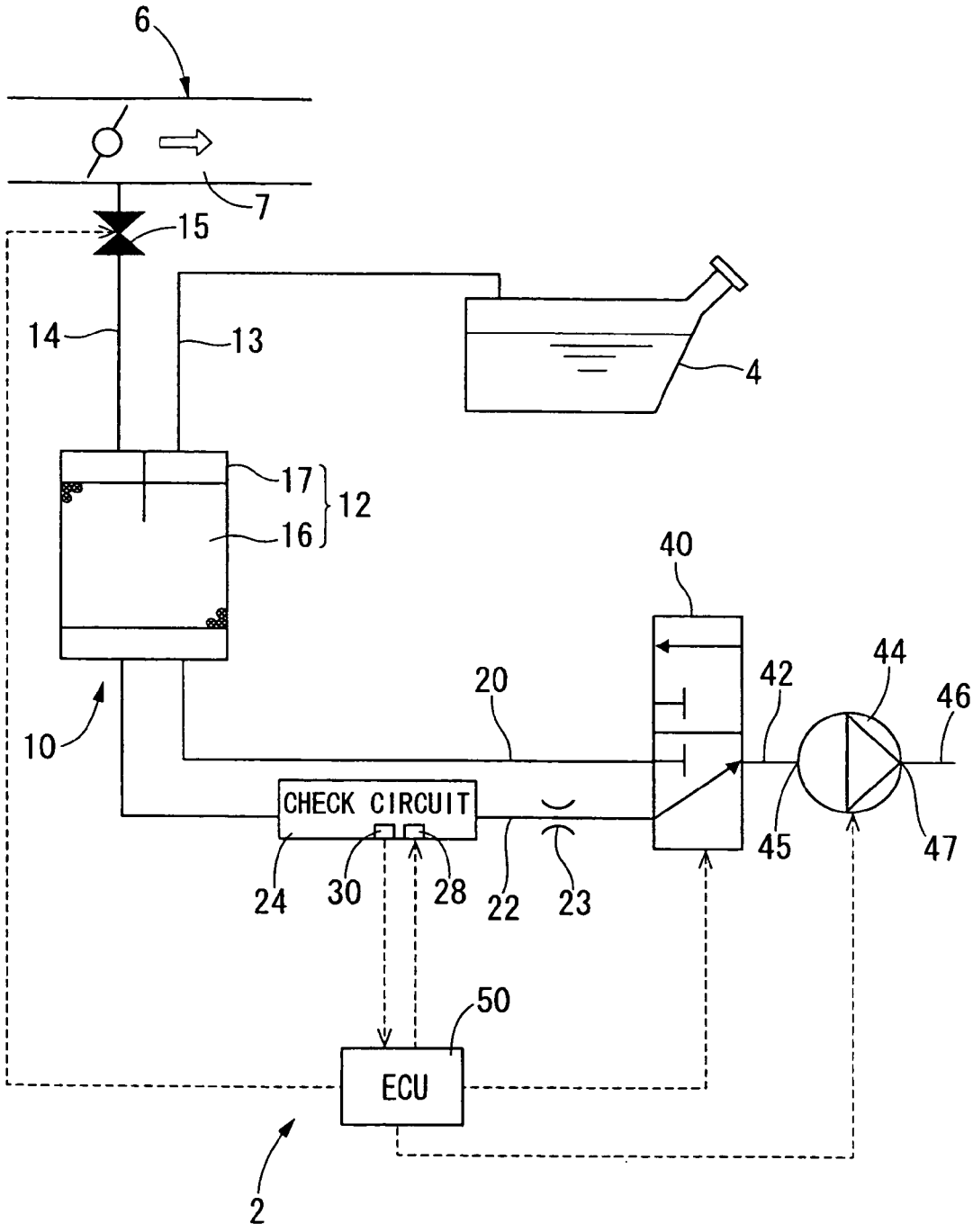
FIG. 5 is a block diagram showing the operation of the evaporative fuel handling apparatus of FIG. 1.

In step S24, the ECU 50 controls the selector valve 40 to make the second communication passage 22 communicate with the pump 44 as shown in FIG. 5. This state of communication is maintained until the leak check flow is completed.

Next, in step S25, the ECU 50 controls the communication control valve 28 to make the atmosphere passage 27 communicate with the first check passage 25 as shown in FIG. 2. Then, in step S26, the ECU 50 controls the pump 44 to depressurize the second communication passage 22 and controls the pressure sensor 30 to detect the pressure in the second check passage 26. Depressurization of the second communication passage 22 coincidentally causes depressurization of the passages 26, 29, 25, and 27 because these passages communicate with each other. Thus, in step S26, the detected pressure corresponds to the pressure of gas passing through the check restrictor 32 and is determined by the axial cross sectional area of the check restrictor 32. Hence, the ECU 50 stores the detected pressure as a reference pressure in memory.

After the reference pressure is detected and stored, step S27 commences, in which the ECU 50 makes the second check passage 26 again communicate with the first check passage 25. Then, in step S28, the ECU 50 controls the pump 44 to thereby depressurize the second communication passage 22 and controls the pressure sensor 30 to detect the pressure of the second check passage 26. Depressurization of the second communication passage 22 coincidentally causes depressurization of the passages 26, 25, and 22*a* and to the purge system 10 because they are each in communication. By detecting the pressure in the second check passage 26 in step S28, the leak check is performed. More specifically, the ECU 50 compares the pressure detected in step S28 to the above-mentioned reference pressure to determine whether leak occurs or not. In other words, if a leak exists the pressure detected in step S28 will change (i.e., increase or decrease) according to the size of the leak opening of the purge system 10.

Thereafter, in step S29, the ECU 50 makes the atmosphere passage 27 again communicate with the first check passage 25 to detect the atmospheric pressure. Then, the leak check is finished.

Figure 7:
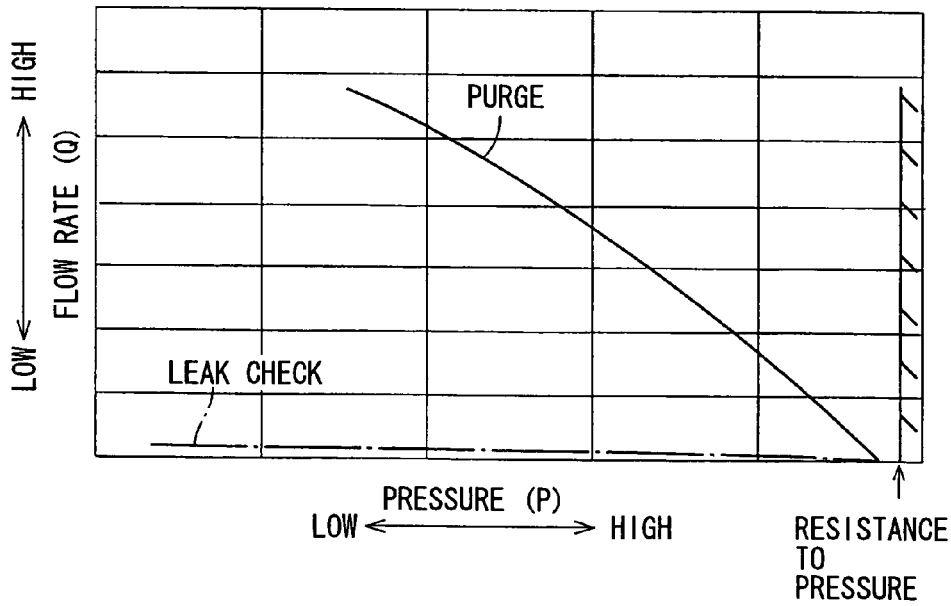
FIG. 7 is a schematic diagram showing the characteristics of the evaporative fuel handling apparatus of FIG. 1.

According to the first embodiment described above, a loss of pressure of flowing fluid is larger in the second communication passage 22 than in the first communication passage 20. Hence, as shown in FIG. 7, the inclination of the P-Q characteristic curve of the pump 44 becomes smaller at the time of executing step S26 and step S28 (i.e., performing the leak check by depressurization of the second communication passage 22) than at the time of executing step S12 (i.e., performing the forcible purge by pressurizing the first communication passage 20). Accordingly, the pump 44 is able to produce a characteristic in which the flow rate is large and in which pressure is lower than a value of resistance to pressure of the apparatus 2 for performing the forcible purge, and the same pump 44 is able to produce a characteristic in which a change in pressure with respect to a change in flow rate is small while performing the leak check. Hence, it is possible to perform the forcible purge and the leak check using a common pump 44, so that it is possible to reduce the size and weight of the apparatus 2. As a result, the apparatus 2 is less expensive, more compact, and the apparatus 2 can be constructed and mounted more easily.

Further, according to the first embodiment, in step S12 (where the forcible purge is performed) the pump 44 pressurizes the canister 12 and purge passage 14 of the purge system 10 through the first communication passage 20. As such, it is possible to reduce evaporative fuel desorbed from the canister 12 from extending to and being sucked by the pump 44. Hence, it is possible to lower the levels of hermeticity, reduce the likelihood of explosion, and reduce the resistance to evaporation.

Still further, according to the first embodiment, the first and second communication passages 20, 22 are pressurized and depressurized, respectively. Hence, the direction of discharge of the pump 44 during the forcible purge in step S12 is opposite to the direction of discharge of the pump 44 at the time of leak checking in step S26 and S28. Hence, construction can be simplified by employing a mode of reversing the direction of discharge of the pump 44 in this manner.

In addition, according to the first embodiment, the magnitude of loss of pressure in the second communication passage 22 and the pump characteristic during leak checking of steps S26 and S28 vary according to the amount of axial cross sectional area restriction provided by the restrictor 23. Hence, for example, a pump 44 having a characteristic appropriate for the forcible purge can be easily incorporated for leak checking by adjusting the amount of restriction by the restrictor 23 until the pump characteristic is appropriate for leak checking.

Second Embodiment

Figure 8:
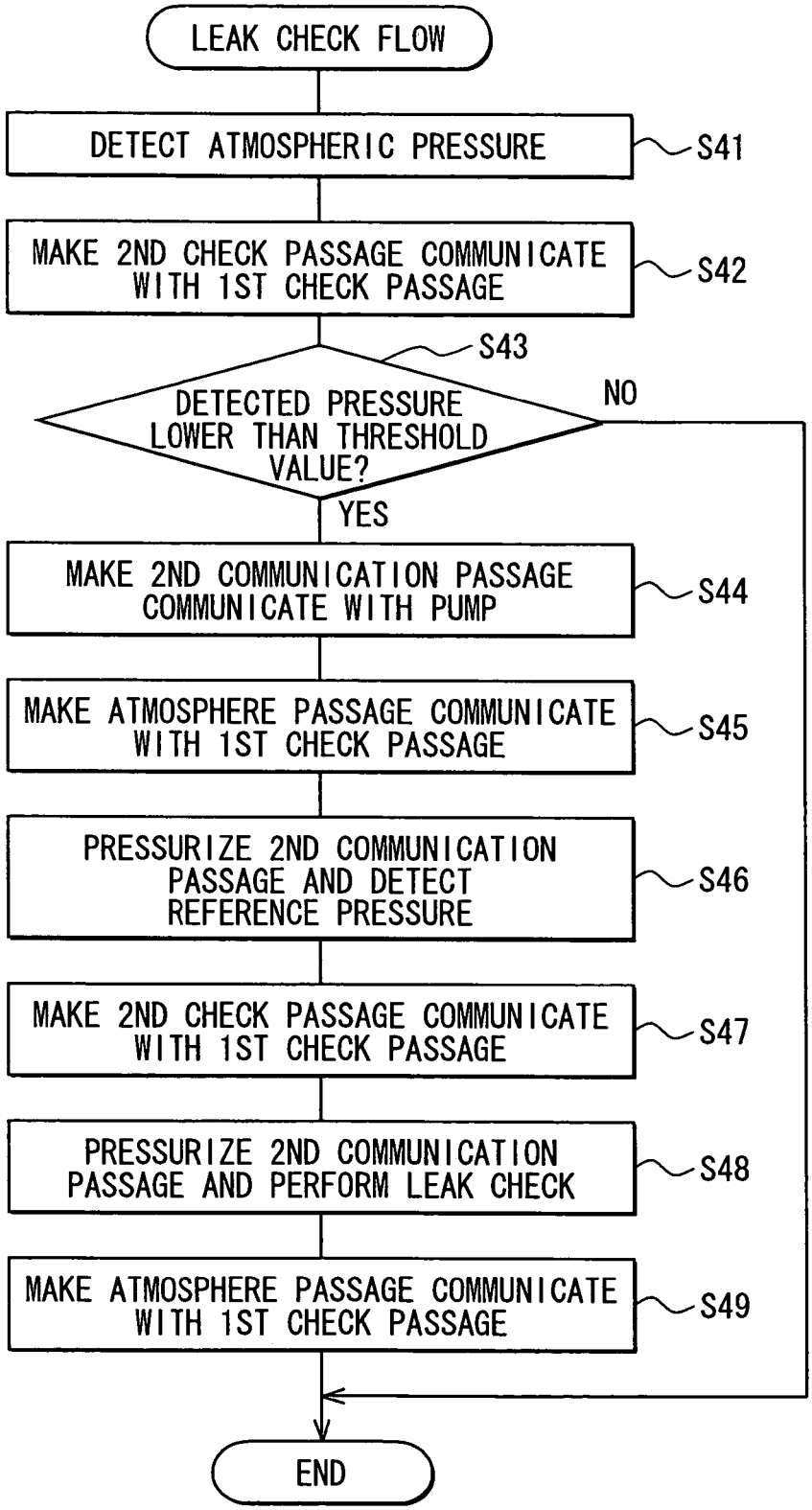
FIG. 8 is a flow chart showing the operation of an evaporative fuel handling apparatus according to a second embodiment.
Figure 9:
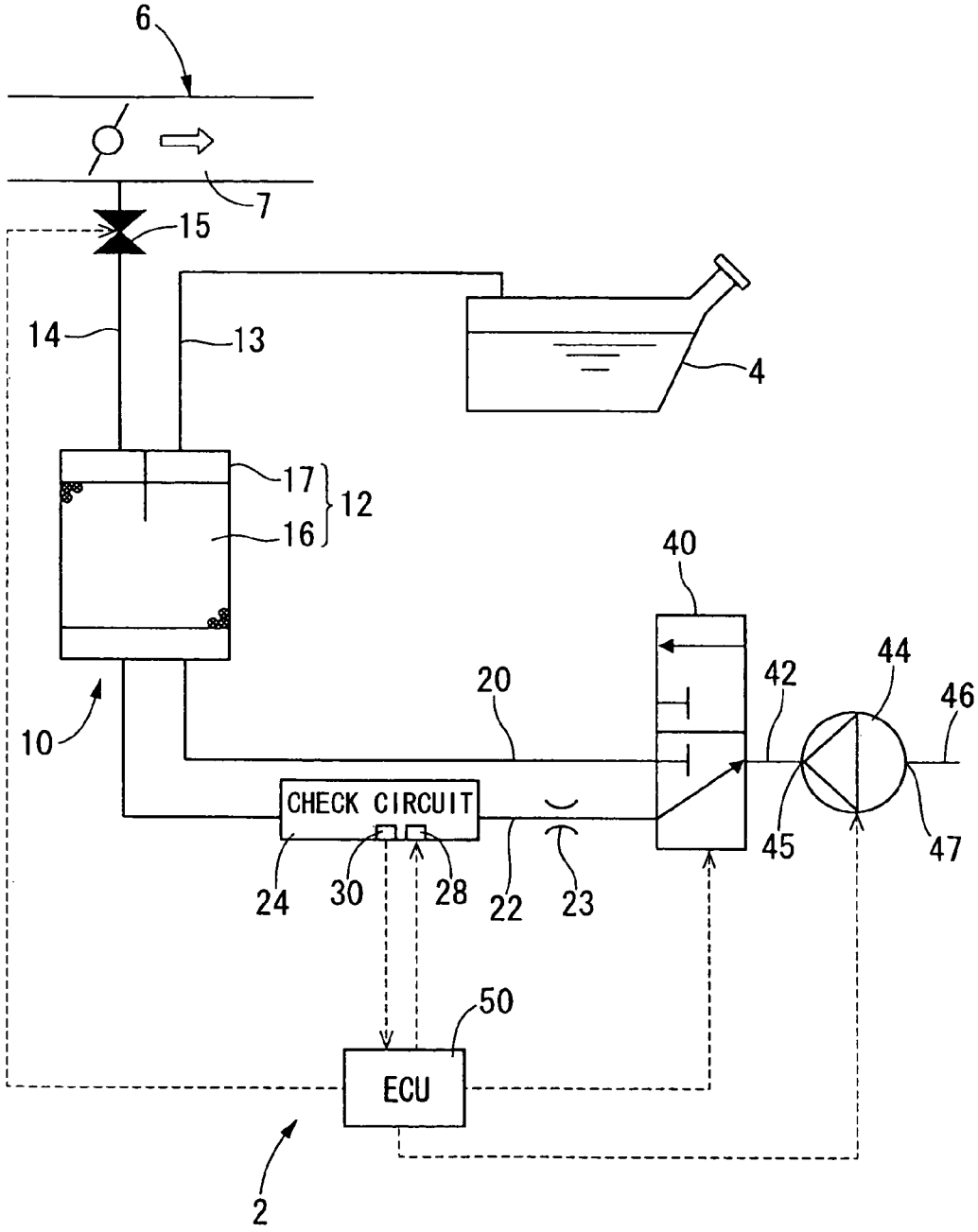
FIG. 9 is a block diagram of the second embodiment of FIG. 8.

As shown in FIGS. 8 and 9, a second embodiment of the present disclosure is illustrated. Specifically, in the leak check flow of the second embodiment, steps S46 and S48 in which the second communication passage 22 is pressurized is executed in place of S26 and S28 in which the second communication passage 22 is depressurized.

As such, the direction of discharge of the pump 44 is the same during the forcible purge in step S12 as the direction of discharge of the pump 44 during the leak check of steps S46 and S48. Hence, it is possible to use an inexpensive pump 44 that does not change the direction of discharge.

It will be appreciated that in the second embodiment, a pump 44 that can change the direction of discharge may be employed. It will be appreciated that steps S41 through S45, S47, and S49 in the leak check flow of the second embodiment are substantially the same as steps S21 through S25, S27, and S29, respectively, of the first embodiment.

Third Embodiment

Figure 10:
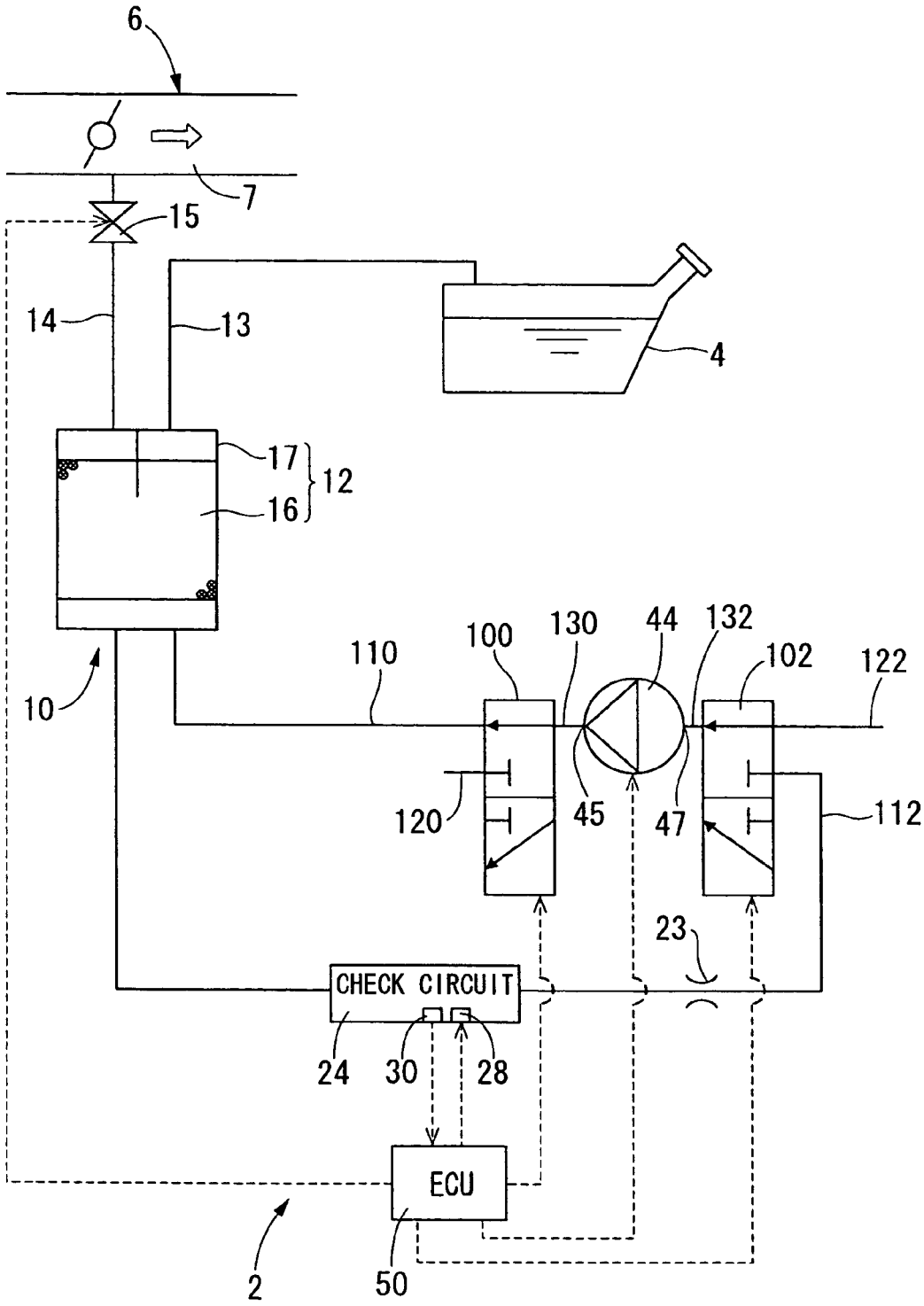
FIG. 10 is a block diagram showing an evaporative fuel handling apparatus according to a third embodiment.

Referring now to FIG. 10, a third embodiment of the present invention is illustrated. The third embodiment is a modified embodiment of the first embodiment. Specifically, in the third embodiment, the selector valve 40 and the first and second communication passages 20, 22 are not arranged on one side of the pump 44 similar to the first embodiment. Instead, a combination of a first selector valve 100 and first communication passage 110 and another combination of a second selector valve 102 and a second communication passage 112 are arranged on opposite sides of the pump 44.

The first selector valve 100 is fluidly coupled to the first communication passage 110, a first open passage 120 that is open to the atmosphere at one end, and a first pump passage 130 fluidly coupled to the first port 45 of the pump 44. As such, the first selector valve 100 switches to allow fluid communication between the pump passage 130 (i.e., the pump 44) and either the first communication passage 110 or the first open passage 120. In one embodiment, the first selector valve 100 is an electromagnetically driven three-way valve.

Moreover, the second selector valve 102 is connected to the second communication passage 112, a second open passage 122 that is open to the atmosphere at one end, and a second pump passage 132 that is fluidly coupled to the second port 47 of the pump 44. As such, the second selector valve 102 switches to allow fluid communication between the second pump passage 132 and either the second communication passage 112 or the second open passage 122. In one embodiment, the second selector valve 102 is made of an electromagnetically driven three-way valve. Also, in the embodiment shown, the first and second selector valves 100, 102 are electrically connected to the ECU 50 and are controlled and operated by the ECU 50.

Figure 11:
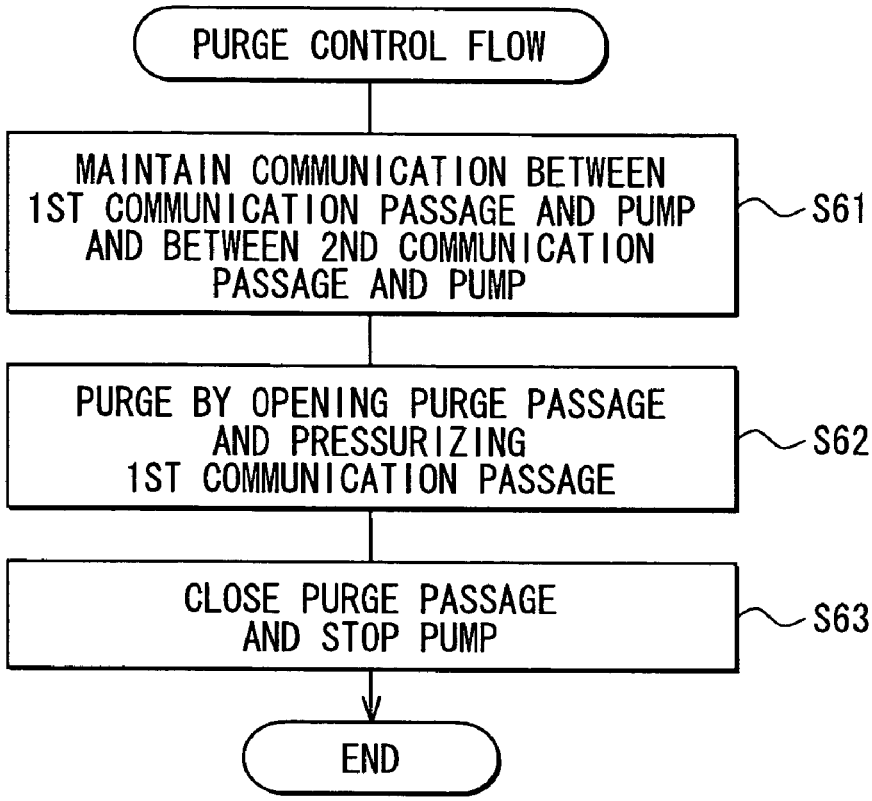
FIG. 11 is a flow chart showing the operation of the evaporative fuel handling apparatus of FIG. 10.

Next, a purge control flow of the third embodiment will be described on the basis of the flow chart in FIG. 11. Here, when the purge control flow is started, the first communication passage 110 is made to communicate with the pump 44 by the first selector valve 100, and the second open passage 122 is made to communicate with the pump 44 by the second selector valve 102.

In step S61 of the purge control flow, as shown in FIG. 10, the ECU 50 controls the first and second selector valves 100, 102 to maintain a state in which the first communication passage 110 is in fluid communication with the pump 44 and the second open passage 122 is in fluid communication with the pump 44. This state is continuously held at least until the present purge control flow is finished. Then, in step S62, the ECU 50 opens the purge passage 14 and controls the pump 44 to pressurize the first communication passage 110. Pressurization of the first communication passage 110 pressurizes the canister 12 and the purge passage 14, such that fuel desorbed from the canister 12 is forcibly purged into the intake passage 7. Thereafter, step S63 is executed in a substantially similar manner to step S13 of the first embodiment, and the purge control flow is completed.

Figure 12:
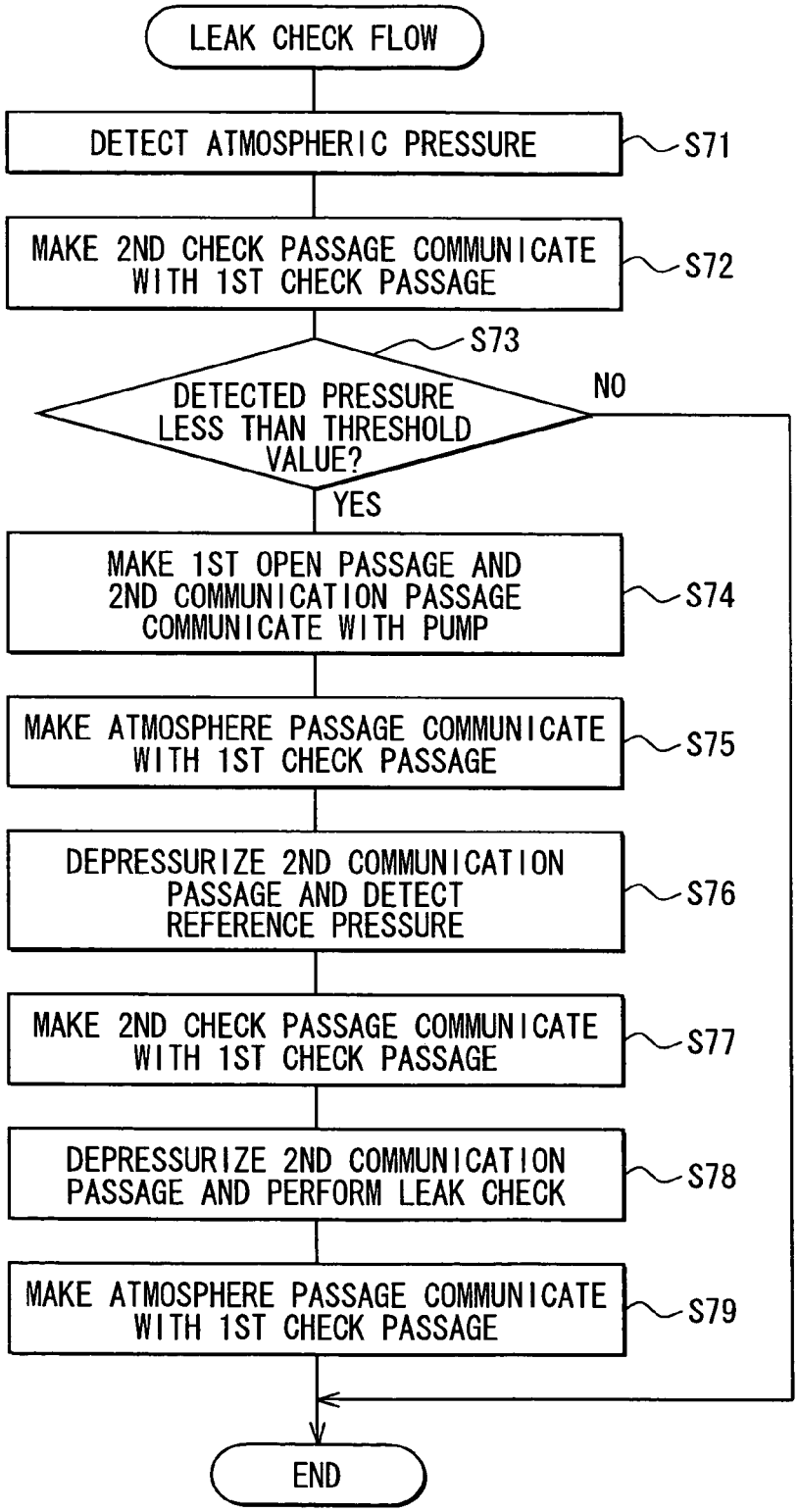
FIG. 12 is a flow chart showing the operation of the evaporative fuel handling apparatus of FIG. 10.

Next, the leak check flow of the third embodiment will be described on the basis of the flow chart the FIG. 12. In one embodiment, when the leak check flow is started, the first communication passage 110 is made to communicate with the pump 44 by the first selector valve 100 and the second open passage 122 is made to communicate with the pump 44 by the second selector valve 102.

Figure 13:
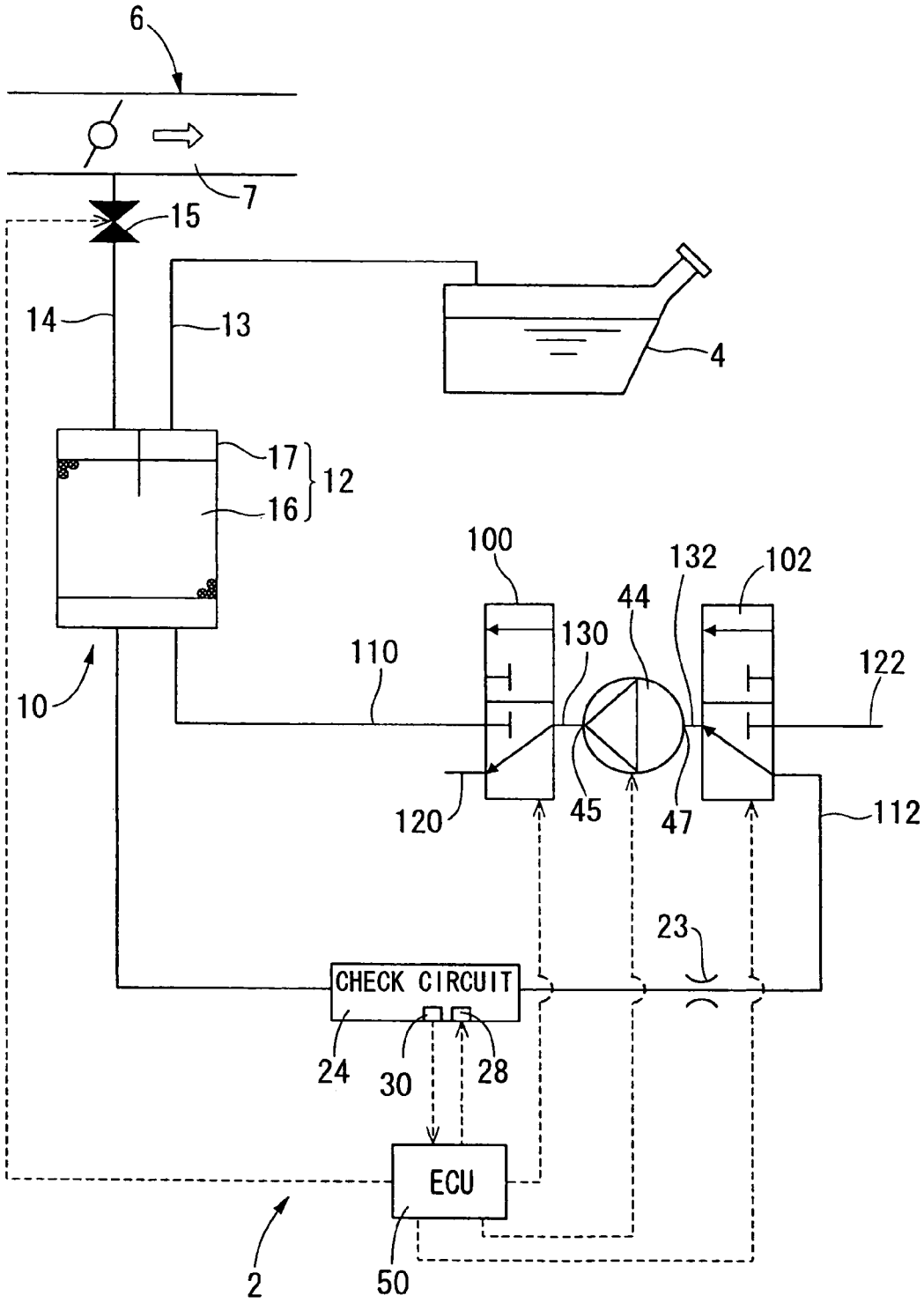
FIG. 13 is a block diagram showing the operation of the evaporative fuel handling apparatus of FIG. 10.

First, steps S71 through S73 of the leak check flow are substantially similar to steps S21 through S27, respectively, of the first embodiment. Next, in step S74, as shown in FIG. 13, the ECU 50 controls the first selector valve 100 to make the first open passage 120 communicate with the pump 44 and controls the second selector valve 102 to make the second communication passage 112 communicate with the pump 44. This mode of communication is maintained at least until this leak check flow is finished. Next, steps S75 through S79 are substantially similar to steps S25 through S29, respectively, of the first embodiment.

Thus, according to the third embodiment, the direction of discharge of the pump 44 remains the same for performing the forcible purge in step S62 and for the leak checking of steps S76 and S78. Hence, it is possible to use an inexpensive pump 44 that does not change the direction of discharge. It will be appreciated, however, that a pump 44 capable of changing the direction of discharge may be used.

Fourth Embodiment

Figure 14:
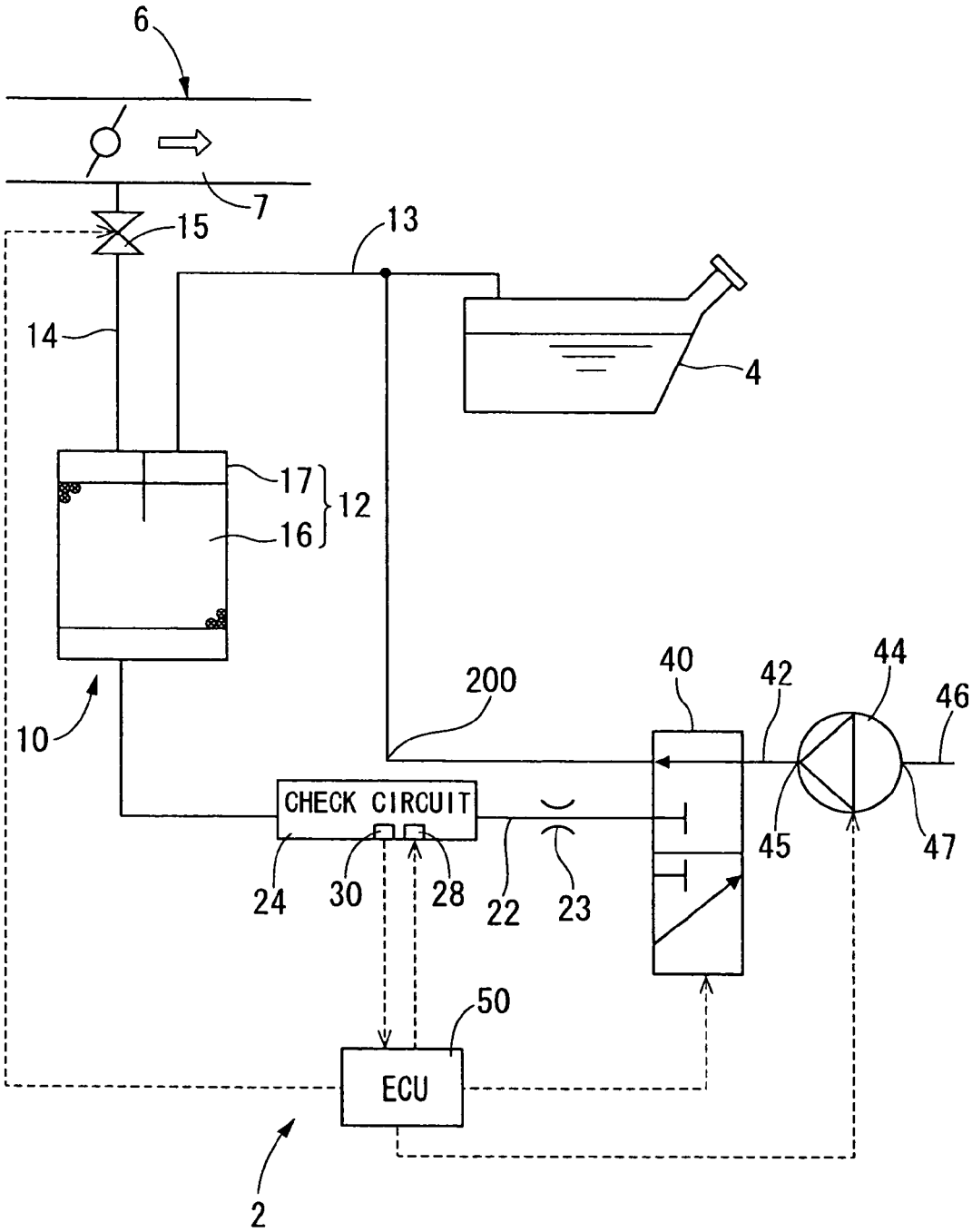
FIG. 14 is a block diagram showing an evaporative fuel handling apparatus according to a fourth embodiment.

As shown in FIG. 14, a fourth embodiment of the present invention is a modification example of the first embodiment. Specifically, a first communication passage 200 is included that is fluidly coupled to the introduction passage 13. As such, the first connection passage 200 communicates with the canister 12 through the introduction passage 13. Hence, in step S12 of the purge control flow, the action of pressurizing the first communication passage 200 by the pump 44 causes pressurization of the canister 12 and the purge passage 14 through the introduction passage 13, and fuel desorbed from the canister 12 is forcibly purged into the intake passage 7. In other words, the introduction passage 13 is purged of gas by the action of pressurizing the first communication passage 200 by the pump 44, so that evaporative fuel flowing into the introduction passage 13 is surely introduced into the canister 12, and the amount of fuel adsorbed by the canister 12 is increased and the amount of fuel desorbed from the canister 12 is increased. Hence, the fourth embodiment can be especially effective for supplying a relatively large amount of purge.

Fifth Embodiment

Figure 15:
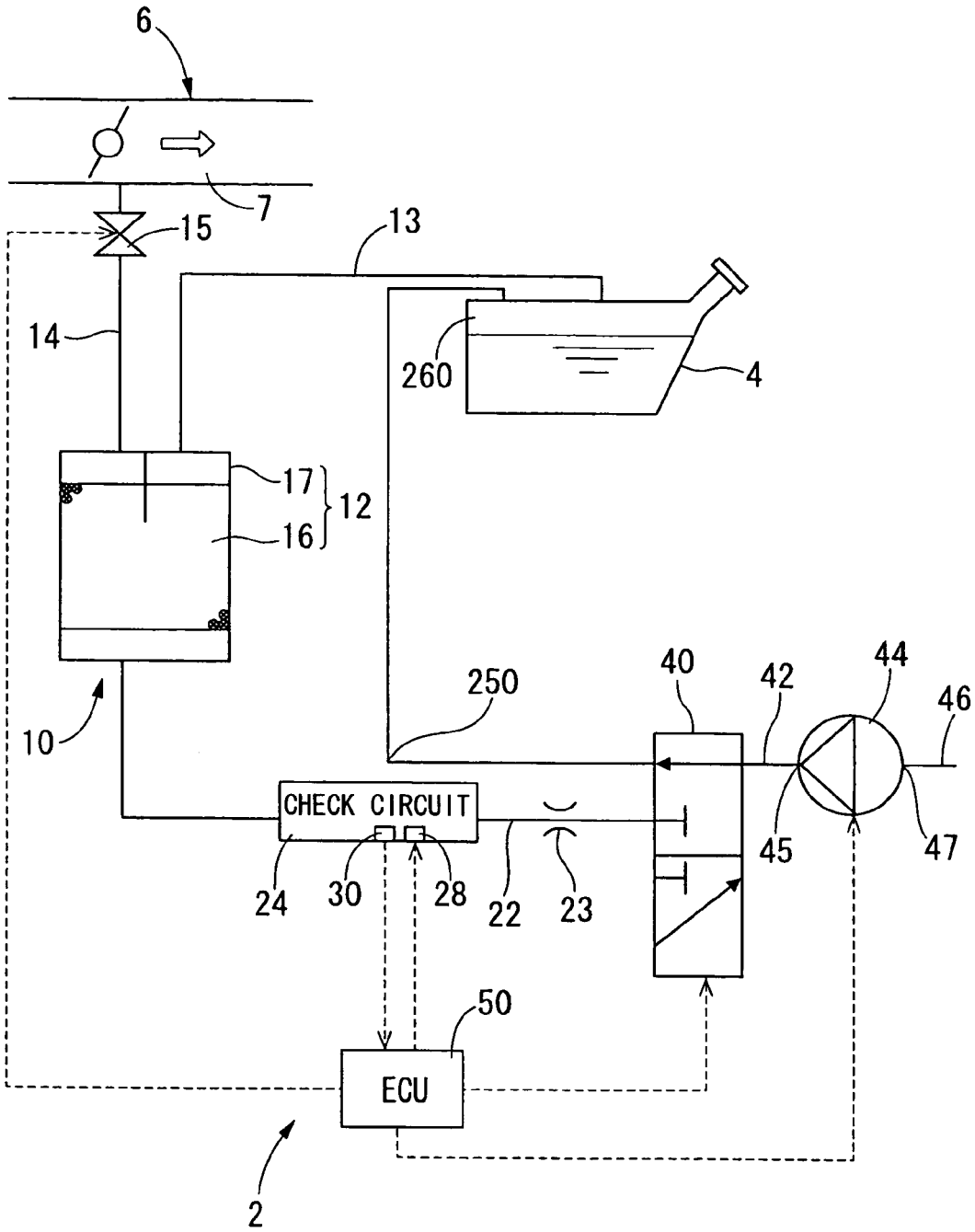
FIG. 15 is a block diagram showing an evaporative fuel handling apparatus according to a fifth embodiment.

Referring now to FIG. 15, a fifth embodiment of the present invention is shown, which is a modification of the first embodiment. Specifically, a first communication passage 250 is included that is fluidly coupled to the fuel tank 4. The introduction passage 13 is separately coupled to the top of the fuel tank 4. As such, the first connection passage 250 is fluidly coupled to the canister 12 through the fuel tank 4 and the introduction passage 13. Hence, in step S12 of the purge control flow, pressurization of the first communication passage 250 by the pump 44 causes pressurization of the canister 12 and the purge passage 14 through the fuel tank 4 and the introduction passage 13, such that fuel desorbed from the canister 12 is forcibly purged into the intake passage 7. Thus, atmosphere can pass over the liquid fuel in the fuel tank 4, so that the amount of evaporative fuel in the fuel tank 4 is made stable. In other words, when performing the forcible purge, the space 260 in the upper portion of the fuel tank 4 and the introduction passage 13 are purged of gas due to the pressurization of the first communication passage 250, so that a stable amount of evaporative fuel is introduced into the canister 12. The concentration of fuel desorbed from the canister 12 is unlikely to fluctuate, and thus, the fifth embodiment provides a stable concentration of purged fuel.

Sixth Embodiment

Figure 16:
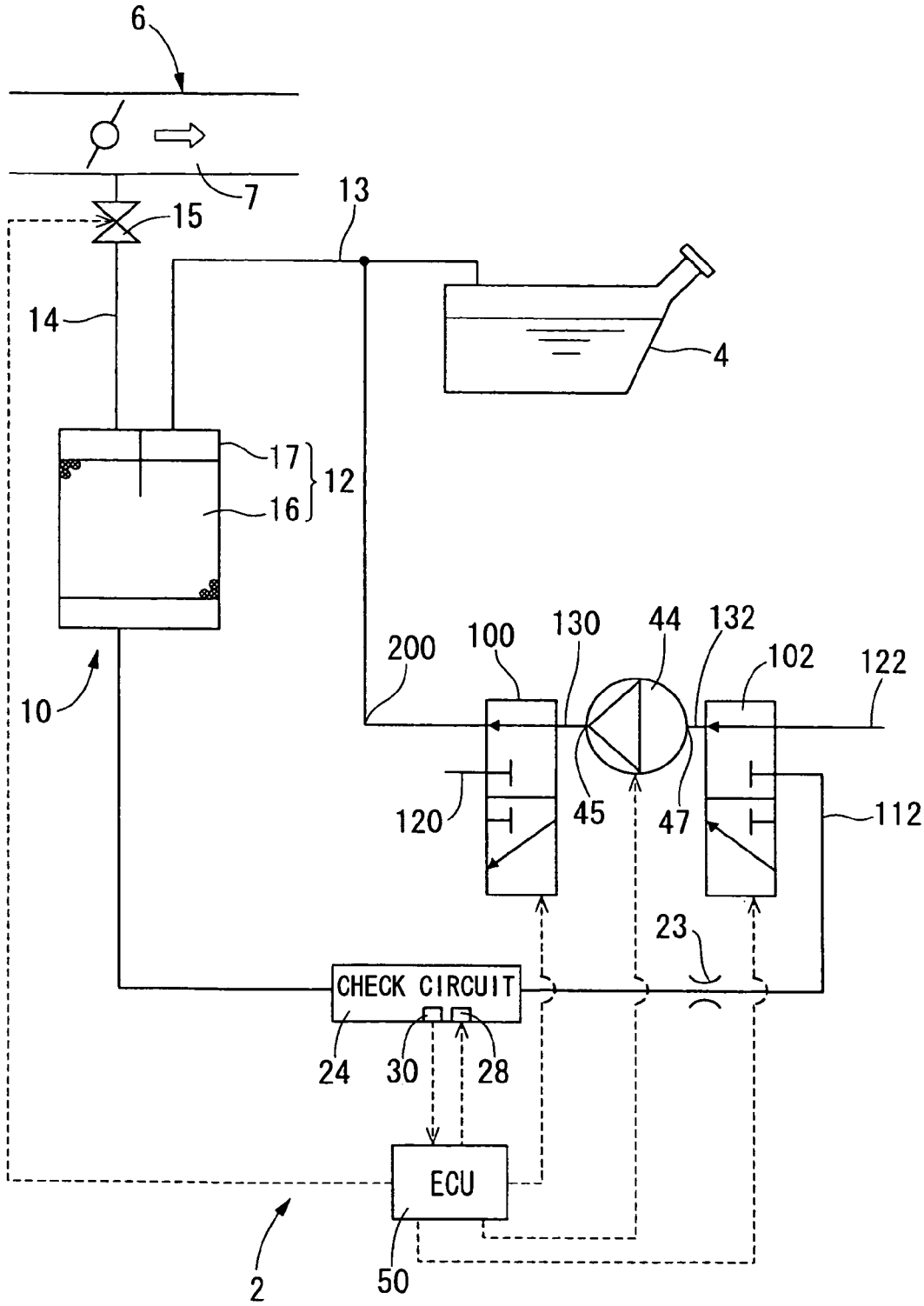
FIG. 16 is a block diagram showing an evaporative fuel handling apparatus according to a sixth embodiment.

Referring now to FIG. 16, a sixth embodiment of the present invention is shown, which is a combination of the third embodiment and the fourth embodiment. Specifically, the sixth embodiment has substantially the same construction as the third embodiment except that a first communication passage 200 is included that is fluidly coupled to the introduction passage 13. Hence, the sixth embodiment can produce the same effect as the third and fourth embodiments.

Seventh Embodiment

Figure 17:
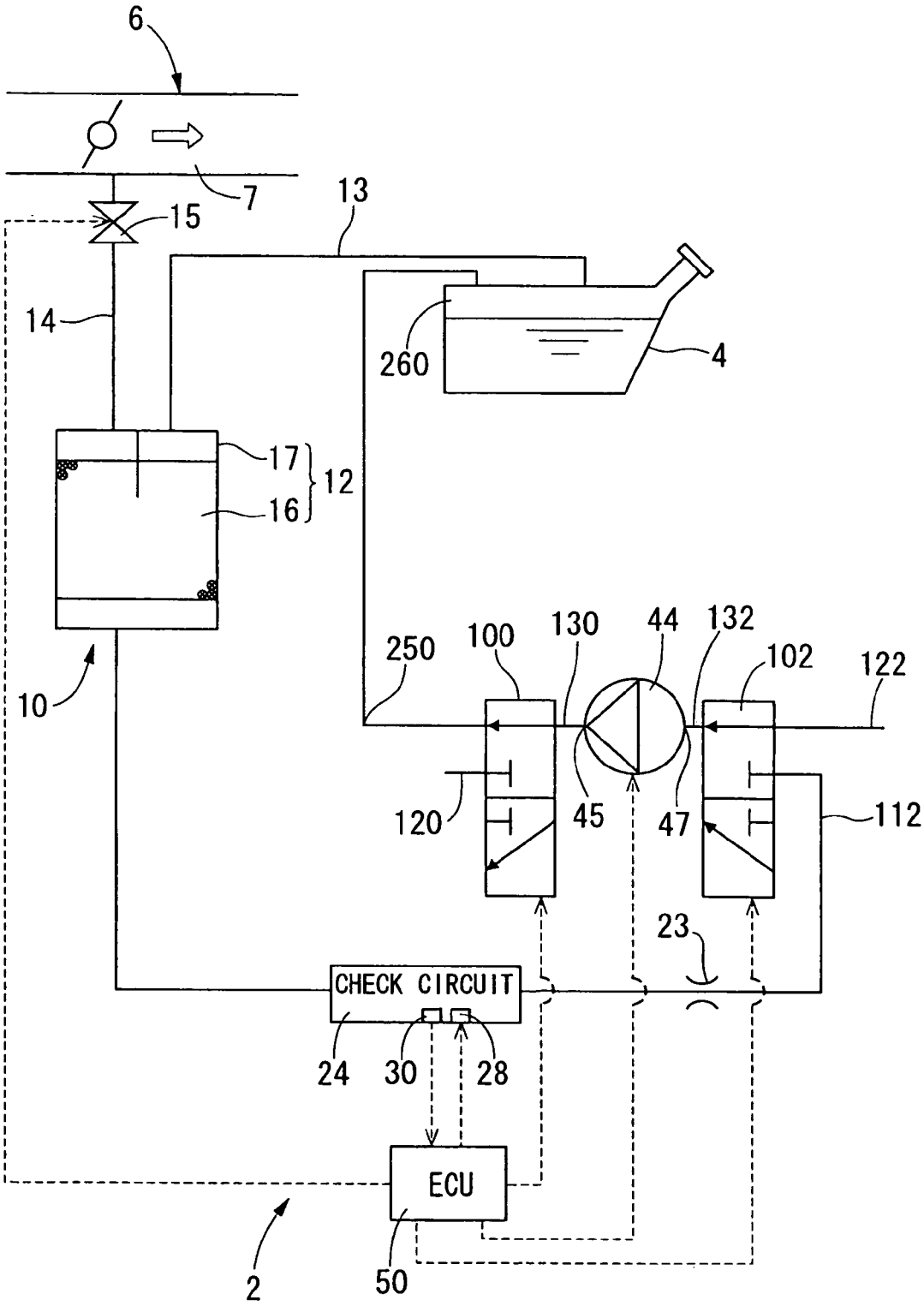
FIG. 17 is a block diagram showing an evaporative fuel handling apparatus according to a seventh embodiment.

Referring now to FIG. 17, a seventh embodiment of the present invention is shown, which is a combination of the third embodiment and the fifth embodiment. Specifically, the seventh embodiment has substantially the same construction as the third embodiment except that a first communication passage 250 is included that is fluidly coupled to the fuel tank 4. Hence, the seventh embodiment can produce the same effect as the third and fifth embodiments.

Eighth Embodiment

Figure 18:
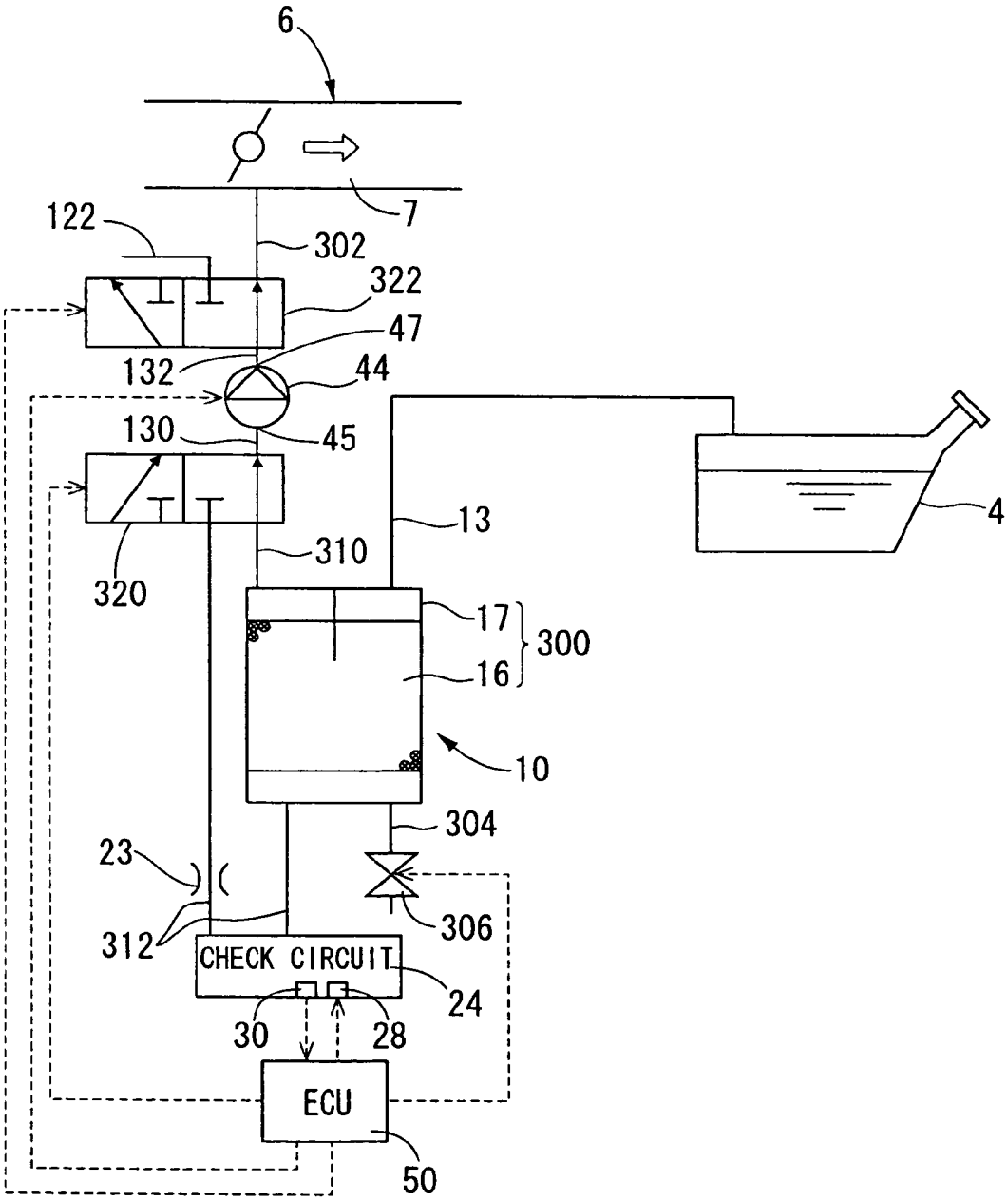
FIG. 18 is a block diagram showing an evaporative fuel handling apparatus according to an eighth embodiment.

Referring now to FIG. 18, an eighth embodiment of the present invention is illustrated that is a modification of the third embodiment. Specifically, in the eighth embodiment, a first open passage 304 is fluidly coupled to the canister 300 on a side opposite to the introduction passage 13 (i.e., across the adsorbent 16), and a first communication passage 310 is fluidly connected to the canister 300 on a side opposite to a second communication passage 312 (i.e., across the adsorbent 16). While the purge control valve 15 is not arranged in the purge passage 302, an opening/closing valve 306 made of an electromagnetically driven two-way valve is arranged in the middle of the first open passage 304. Here, the valve 306 is opened and closed to control the opening/closing of the first open passage 304.

A first pump passage 130 is fluidly coupled to the pump 44 and the first selector valve 320. The first selector valve 320 is also fluidly coupled to the second communication passage 312. The first selector valve 320 can switch to allow fluid communication between the pump 44 and either the first communication passage 310 or the second communication passage 312.

A second pump passage 132 is fluidly coupled to the pump 44 and a second selector valve 322. The second selector valve 322 has a purge passage 302 fluidly coupled thereto. As such, the second selector valve 322 can switch to allow fluid communication between the pump 44 and either the purge passage 302 or the second open passage 122. In one embodiment, the opening/closing valve 306 and the first and second selector valves 320, 322 are electrically connected to the ECU 50 and are controlled and operated by the ECU 50.

Figure 19:
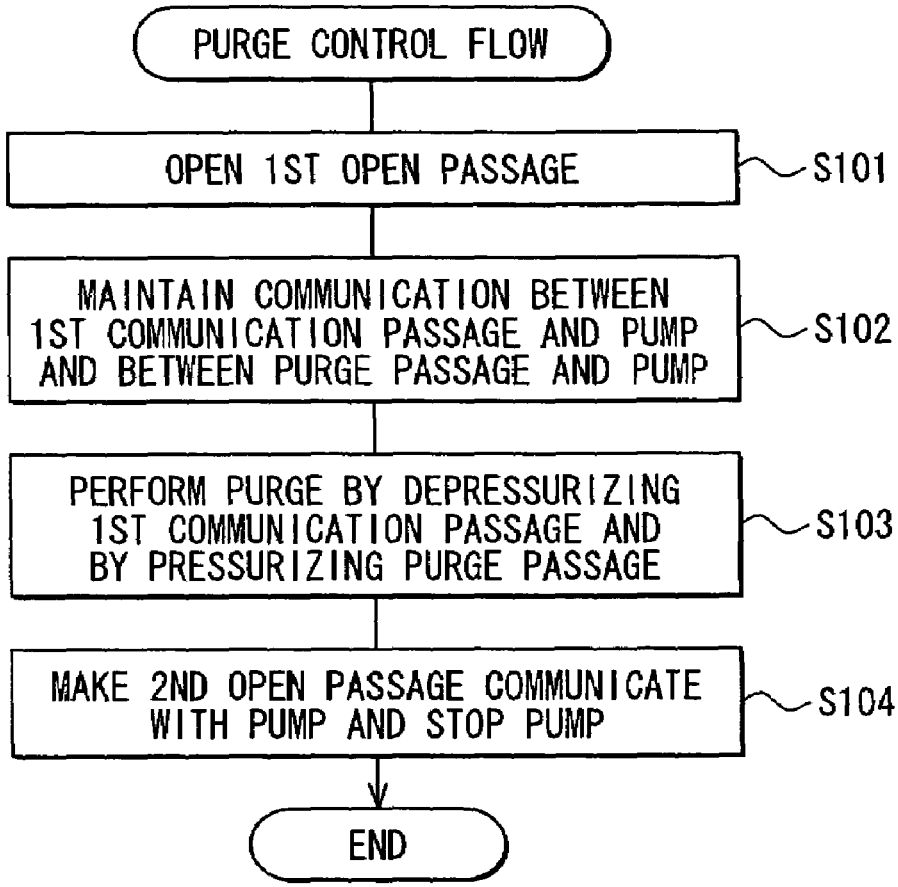
FIG. 19 is a flow chart showing the operation of the evaporative fuel handling apparatus of FIG. 18.

Next, the purge control flow of the eighth embodiment will be described on the basis of a flow chart in FIG. 19. In one embodiment, when the purge control flow is started, the first communication passage 310 is made to communicate with the pump 44 by the first selector valve 320, the second open passage 122 is made to communicate with the pump 44 by the second selector valve 322, and the first open passage 304 is brought into a closed state by the opening/closing valve 306.

In step S101 of the purge control flow, the ECU 50 controls the opening/closing valve 306 to open the first open passage 304. In this embodiment, the opening/closing valve 306 remains open until the purge control flow is finished. Next, in step S102, the ECU 50 controls the first selector valve 320 to maintain fluid communication between the first communication passage 310 and the pump 44, and the ECU 50 controls the second selector valve 322 to make the purge passage 302 fluidly communicate with the pump 44.

Next, in step S103, the ECU 50 controls the pump 44 to depressurize the first communication passage 310 and to pressurize the purge passage 302. Depressurization of the first communication passage 310 causes depressurization of the canister 300, thereby causing evaporative fuel to be desorbed from the canister 300 and sucked through the first port 45 by the pump 44. The evaporative fuel sucked by the pump 44 is discharged from the pump 44 through the second port 47 and then is forcibly purged into the intake passage 7 due to pressurization of the purge passage 302.

Thereafter, in step S104, when the purge stop conditions are established, the ECU 50 controls the second selector valve 322 to make the second open passage 122 fluidly communicate with the pump 44 and stops the pump 44. As such, the forcible purge is completed, and the purge control flow is finished.

Figure 20:
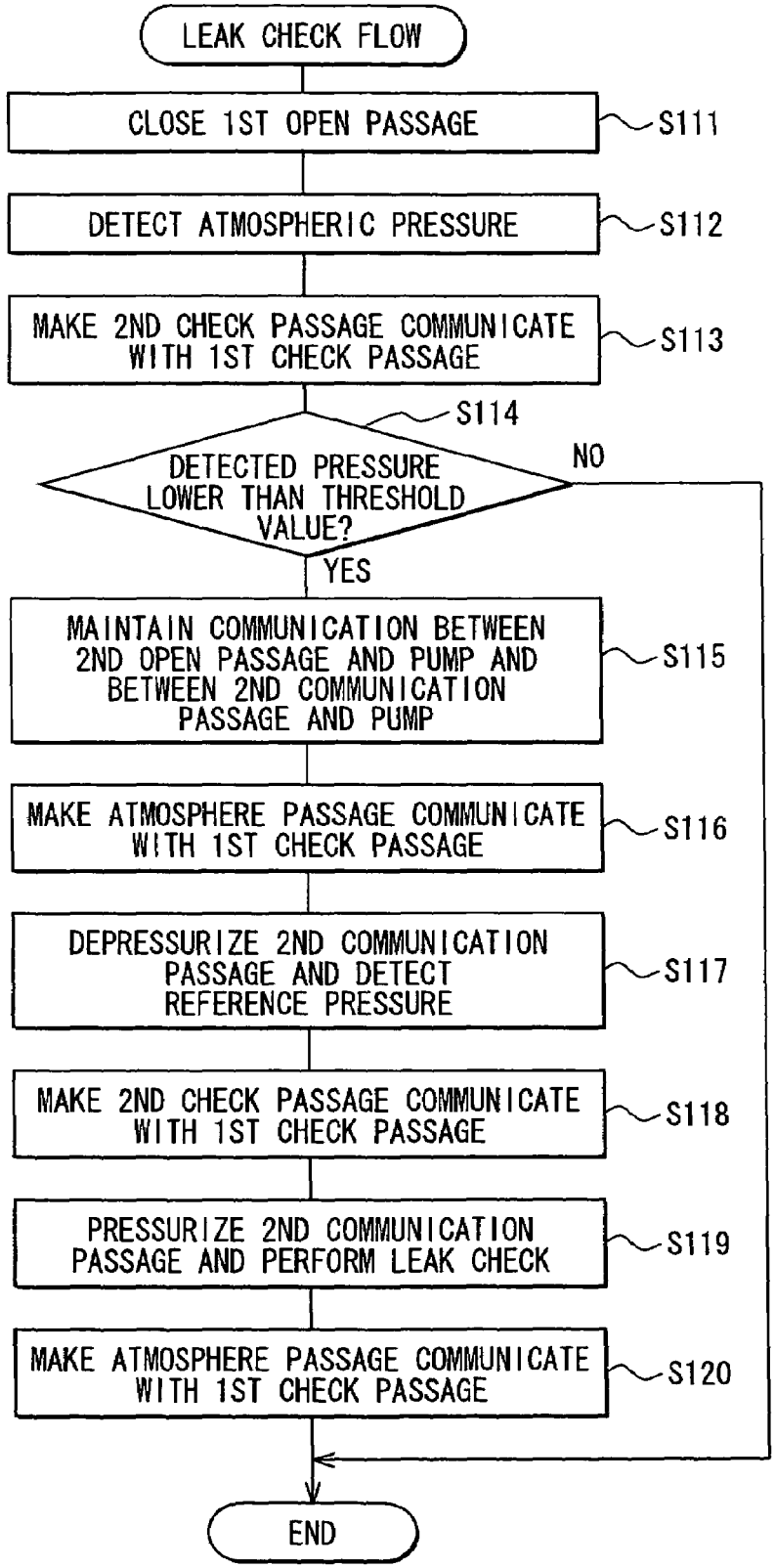
FIG. 20 is a flow chart showing the operation of the evaporative fuel handling apparatus of FIG. 18.

Next, the leak check flow of the eighth embodiment will be described on the basis of the flow chart of FIG. 20. Here, when the leak check flow is started, the first communication passage 310 is made to communicate with the pump 44 by the first selector valve 320, the second open passage 122 is made to communicate with the pump 44 by the second selector valve 322, and the first open passage 304 is brought into an opened state by the opening/closing valve 306.

Figure 21:
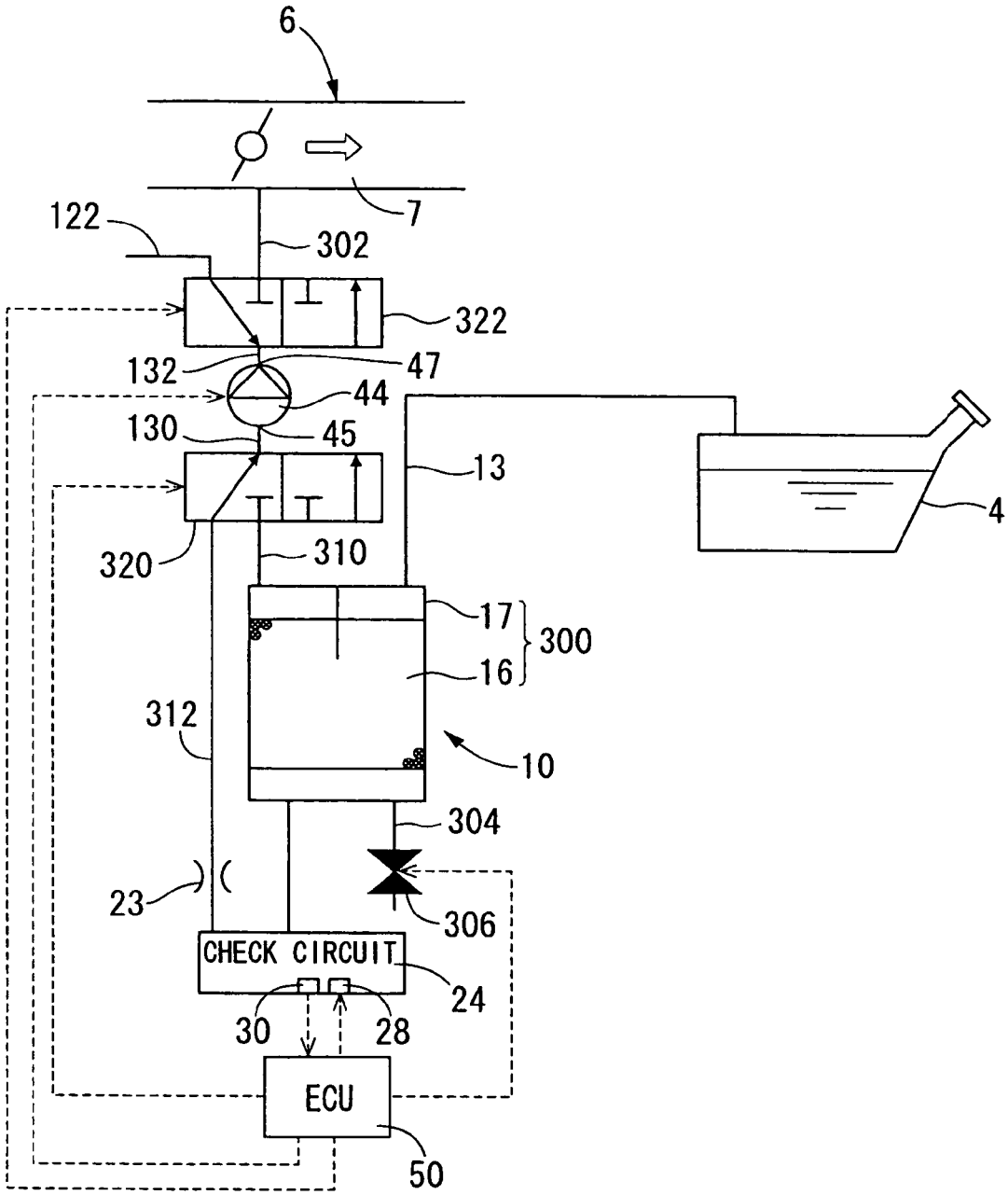
FIG. 21 is a block diagram showing the operation of the evaporative fuel handling apparatus of FIG. 18.

In S111 of the leak check flow, the ECU 50 controls the opening/closing valve 306 to close the first open passage 304. In this embodiment, this closed state is maintained until the leak check flow is completed. The contents of successive steps S112 through S114 are substantially similar as those of steps S71 through S73, respectively, of the third embodiment (i.e., steps S21 through S23, respectively of the first embodiment). Further, in step S115, as shown in FIG. 21, the ECU 50 controls the second selector valve 322 to maintain a state where the second open passage 122 is made to communicate with the pump 44, and the ECU 50 controls the first selector valve 320 to make the second communication passage 312 communicate with the pump 44. In this embodiment, the second open passage 122 remains in communication with the pump 44 until this leak check flow is completed. Also, in this embodiment, the second communication passage 312 remains in communication with the pump 44 until finishing the check.

Steps S116 through S120 executed after S115 are substantially the same as those of steps S75 through S79 of the third embodiment (i.e., steps S25 through S29 of the first embodiment).

Thus, according to the eighth embodiment, the pump 44 is fluidly coupled to the purge passage 302 and can be arranged close to the intake passage 7. As such, flow rate responsivity in purge can be increased. Hence, by controlling the pump 44, the amount of purged fuel can be adjusted with high accuracy. Further, similar to the third embodiment, the direction of discharge of the pump 44 need not be reversed for performing the forcible purge (i.e., step S103) and the leak check (i.e., steps S117 and S119). Hence, it is possible to use an inexpensive pump 44 that does not change the direction of discharge. It will be appreciated, however, that a pump 44 capable of changing the direction of discharge may be used.

While the first to eighth embodiments have been described up to this point, it should not be understood that the present invention is limited to these embodiments but the present invention can be applied to various embodiments without departing from the scope of the present invention.

For example, the third through eighth embodiments, respectively, can be varied such that in steps S26, S28, S76, S78, S117, and S119, the second communication passages 22, 112, 312 are pressurized instead of depressurized similar to the second embodiment. Furthermore, in a variation of the third and sixth through eighth embodiments, the first open passages 120, 304 are made to communicate with the second open passage 122 at least on the end open to the atmosphere.

What is claimed is:

1. An evaporative fuel handling apparatus for a vehicle with an air intake system of an engine and a fuel tank, the evaporative fuel handling apparatus comprising:

a purge system for purging evaporative fuel from the fuel tank into the air intake system, wherein the purge system defines an inside and an outside;

a first communication passage fluidly coupled with the purge system;

a second communication passage fluidly coupled with the purge system;

a first restrictor fluidly coupled to the second communication passage, wherein an axial cross sectional area of the first restrictor is less than an axial cross sectional area of the second communication passage such that the second communication passage has a greater loss of pressure of flowing fluid than the first communication passage;

a check device coupled to the second communication passage for checking a leak of evaporative fuel from the purge system, the check device including a second restrictor and a pressure sensor, wherein the pressure sensor is operatively coupled between the first restrictor and the second restrictor;

a pump for producing a pressure difference between the inside and the outside of the purge system;

a selector device for switching fluid communication of the pump between one of the first communication passage and the second communication passage; and a controller that controls the selector device to allow fluid communication between the first communication passage and the pump and then controls the pump to produce the pressure difference to thereby perform forcible purge of evaporative fuel; and wherein the controller is further operable for controlling the selector device to allow fluid communication between the second communication passage and the pump, and then controls the pump to produce the pressure difference and controls the check device to check for a leak of evaporative fuel.

2. The evaporative fuel handling apparatus as claimed in claim 1, wherein the purge system has a canister for adsorbing evaporative fuel from the fuel tank and purges evaporative fuel desorbed from the canister, and wherein the first communication passage and the second communication passage are fluidly coupled to the canister.

3. The evaporative fuel handling apparatus as claimed in claim 2, further comprising an open passage that is fluidly coupled to the pump and is open to the atmosphere, wherein the purge system has a purge passage fluidly coupled to the air intake system and the canister, and wherein the controller, to perform the forcible purge, controls the selector device to allow fluid communication between the first communication passage and the pump and then controls the pump to pressurize the first communication passage.

4. The evaporative fuel handling apparatus as claimed in claim 3, wherein the controller, to check for a leak, controls the selector device to allow fluid communication between the second communication passage and the pump and then controls the pump to depressurize the second communication passage.

5. The evaporative fuel handling apparatus as claimed in claim 3, wherein the controller, to check for a leak, controls the selector device to allow for fluid communication between the second communication passage and the pump and then controls the pump to pressurize the second communication passage.

6. An evaporative fuel handling apparatus for a vehicle with an air intake system of an engine and a fuel tank, the evaporative fuel handling apparatus comprising:

a purge system for purging evaporative fuel from the fuel tank into the air intake system, wherein the purge system defines an inside and an outside;

a first communication passage fluidly coupled with the purge system;

a second communication passage fluidly coupled with the purge system and having a greater loss of pressure of flowing fluid than the first communication passage;

a check device coupled to the second communication passage for checking a leak of evaporative fuel from the purge system;

a pump for producing a pressure difference between the inside and the outside of the purge system;

a selector device for switching fluid communication of the pump between one of the first communication passage and the second communication passage; and a controller that controls the selector device to allow fluid communication between the first communication passage and the pump and then controls the pump to produce the pressure difference to thereby perform forcible purge of evaporative fuel; and a first open passage and a second open passage that are each open to the atmosphere;

wherein the controller is further operable for controlling the selector device to allow fluid communication between the second communication passage and the pump, and then controls the pump to produce the pressure difference and controls the check device to check for a leak of evaporative fuel;

wherein the purge system has a canister for adsorbing evaporative fuel from the fuel tank and purges evaporative fuel desorbed from the canister, and wherein the first communication passage and the second communication passage are fluidly coupled to the canister;

wherein the purge system has a purge passage that is fluidly coupled to the air intake system and the canister;

wherein the selector device includes a first selection part that switches to allow fluid communication of the pump between one of the first communication passage and the first open passage;

wherein the selector device includes a second selection part that switches to allow fluid communication of the pump between one of the second communication passage and the second open passage;

wherein the controller, to perform the forcible purge, controls the first selection part and the second selection part to allow for fluid communication between the first communication passage and pump and to allow for fluid communication between the second communication passage and the pump, and then controls the pump to pressurize the first communication passage.

7. The evaporative fuel handling apparatus as claimed in claim 6, wherein the controller, to check for a leak, controls the first selection part and the second selection part to allow for fluid communication between first open passage and the pump and to allow for fluid communication between the second communication passage and the pump, and then controls the pump to depressurize the second communication passage.

8. The evaporative fuel handling apparatus as claimed in claim 6, wherein the controller, to check for a leak, controls the first selection part and the second selection part to allow for fluid communication between the first open passage and the pump and to allow for fluid communication between the second communication passage and the pump, and then controls the pump to pressurize the second communication passage.

9. The evaporative fuel handling apparatus as claimed in claim 2, wherein the first communication passage is directly fluidly coupled to the canister.

10. The evaporative fuel handling apparatus as claimed in claim 2, wherein the purge system includes an introduction passage for introducing evaporative fuel from the fuel tank into the canister, and wherein the first communication passage is fluidly coupled to the introduction passage, such that fluid communication between the first communication passage and the canister occurs through the introduction passage.

11. An evaporative fuel handling apparatus for a vehicle with an air intake system of an engine and a fuel tank, the evaporative fuel handling apparatus comprising:

a purge system for purging evaporative fuel from the fuel tank into the air intake system, wherein the purge system defines an inside and an outside;

a first communication passage fluidly coupled with the purge system;

a second communication passage fluidly coupled with the purge system and having a greater loss of pressure of flowing fluid than the first communication passage;

a check device coupled to the second communication passage for checking a leak of evaporative fuel from the purge system;

a pump for producing a pressure difference between the inside and the outside of the purge system;

a selector device for switching fluid communication of the pump between one of the first communication passage and the second communication passage; and a controller that controls the selector device to allow fluid communication between the first communication passage and the pump and then controls the pump to produce the pressure difference to thereby perform forcible purge of evaporative fuel; and wherein the controller is further operable for controlling the selector device to allow fluid communication between the second communication passage and the pump, and then controls the pump to produce the pressure difference and controls the check device to check for a leak of evaporative fuel;

wherein the purge system has a canister for adsorbing evaporative fuel from the fuel tank and purges evaporative fuel desorbed from the canister, and wherein the first communication passage and the second communication passage are fluidly coupled to the canister; and wherein the purge system includes an introduction passage for introducing evaporative fuel from the fuel tank into the canister, and wherein the first communication passage is fluidly coupled to the fuel tank, such that fluid communication between the first communication passage and the canister occurs through the fuel tank and the introduction passage.

12. The evaporative fuel handling apparatus as claimed in claim 2, further comprising an open passage that is open to the atmosphere;

wherein the purge system has a purge passage fluidly coupled with the air intake system;

wherein the selector device includes a first selection part that switches for allowing fluid communication of the pump between one of the first communication passage and the second communication passage;

wherein the selector device further includes a second selection part that switches to allow fluid communication of the pump between one of the open passage and the purge passage;

and wherein the controller, to perform the forcible purge, controls the first selection part to allow for fluid communication between the first communication passage and the pump, controls the second selection part to allow for fluid communication between the purge passage and the pump, and then controls the pump to depressurize the first communication passage and to pressurize the purge passage.

13. The evaporative fuel handling apparatus as claimed in claim 12, wherein the controller, to check for a leak, controls the first selection part to allow for fluid communication between the second communication passage and the pump, controls the second selection part to allow for fluid communication between the open passage and the pump, and then controls the pump to depressurize the second communication passage.

14. The evaporative fuel handling apparatus as claimed in claim 12, wherein the controller, to check for a leak, controls the first selection part to allow for fluid communication between the second communication passage and the pump, controls the second selection part to allow for fluid communication between the open passage and the pump, and then controls the pump to pressurize the second communication passage.

* * * * *